US009145275B2

(12) United States Patent
Ito et al.

(10) Patent No.: US 9,145,275 B2
(45) Date of Patent: Sep. 29, 2015

(54) FEED APPARATUS AND IMAGE RECORDING APPARATUS

(71) Applicant: BROTHER KOGYO KABUSHIKI KAISHA, Nagoya-shi, Aichi-ken (JP)

(72) Inventors: Tsuyoshi Ito, Nagoya (JP); Yuta Uchino, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/501,615

(22) Filed: Sep. 30, 2014

(65) Prior Publication Data

US 2015/0158685 A1 Jun. 11, 2015

(30) Foreign Application Priority Data

Dec. 11, 2013 (JP) ..... 2013-255910

(51) Int. Cl.

| | |
|---|---|
| ***B65H 3/06*** | (2006.01) |
| ***B65H 5/06*** | (2006.01) |
| ***B65H 3/52*** | (2006.01) |
| ***B65H 3/66*** | (2006.01) |

(52) U.S. Cl.

CPC ..... *B65H 3/0684* (2013.01); *B65H 3/0661* (2013.01); *B65H 3/0669* (2013.01); *B65H 3/5223* (2013.01); *B65H 3/66* (2013.01); *B65H 5/068* (2013.01); *B65H 2301/42346* (2013.01); *B65H 2301/423245* (2013.01); *B65H 2404/725* (2013.01); *B65H 2405/1134* (2013.01); *B65H 2405/11162* (2013.01); *B65H 2513/50* (2013.01)

(58) Field of Classification Search

CPC ..... B65H 1/02; B65H 1/027; B65H 3/0661; B65H 3/0669; B65H 3/0684; B65H 3/34; B65H 3/5207; B65H 3/5215; B65H 3/5223; B65H 3/66; B65H 2301/4232; B65H 2301/42324; B65H 2301/42328; B65H 2301/423245; B65H 2301/4234; B65H 2301/42346; B65H 2404/722; B65H 2404/725; B65H 2405/11161; B65H 2405/11162; B65H 2405/1118; B65H 2405/11134; B65H 2405/324; B65H 2405/325; B65H 2513/10; B65H 2513/50; B65H 2513/512; B65H 2513/514; B65H 2601/2531

See application file for complete search history.

(56) References Cited

U.S. PATENT DOCUMENTS

| | | | | |
|---|---|---|---|---|
| 6,102,389 | A | 8/2000 | Sakurai et al. | |
| 6,382,621 | B1 * | 5/2002 | Inoue et al. | 271/120 |
| 6,540,220 | B2 * | 4/2003 | Kuo et al. | 271/118 |
| 6,626,595 | B2 * | 9/2003 | Kabamoto | 400/624 |

(Continued)

FOREIGN PATENT DOCUMENTS

JP H10139197 A 5/1998

*Primary Examiner* — Ernesto Suarez
(74) *Attorney, Agent, or Firm* — Merchant & Gould PC

(57) ABSTRACT

There is provided a feed apparatus including a support unit; a feed roller; a swingable arm to support the feed roller; a guide unit; a movable member movable to a retracted position and a protruding position at which the movable member can abut against the sheet supported by the support unit; a driving source; driving transmission units; and a contact-separating mechanism to move the feed roller to a separated position and an abutment position at which the feed roller abuts against the sheet supported by the support unit. In a state in which the movable member is the protruding position and the feed roller is the separated position, a time required to start feeding of the sheet by the feed roller moved from the separated position to the abutment position is longer than a time required to shift the movable member from the protruding position to the retracted position.

8 Claims, 14 Drawing Sheets

(56) References Cited

U.S. PATENT DOCUMENTS

| | | | | |
|---|---|---|---|---|
| 7,029,004 | B2 * | 4/2006 | Asada et al. | 271/121 |
| 7,128,317 | B2 * | 10/2006 | Johnson et al. | 271/121 |
| 7,156,388 | B2 * | 1/2007 | Kang et al. | 271/110 |
| 7,210,677 | B2 * | 5/2007 | Fukumura et al. | 271/10.01 |
| 7,370,858 | B2 * | 5/2008 | Youn | 271/121 |
| 8,162,312 | B2 * | 4/2012 | Tu et al. | 271/121 |
| 8,807,556 | B2 * | 8/2014 | Sugiyama et al. | 271/124 |
| 8,899,575 | B2 * | 12/2014 | Hakamata | 271/124 |
| 2008/0061494 | A1 * | 3/2008 | Chen | 271/117 |

* cited by examiner

FEED APPARATUS AND IMAGE RECORDING APPARATUS

CROSS REFERENCE TO RELATED APPLICATION

The present application claims priority from Japanese Patent Application No. 2013-255910, filed on Dec. 11, 2013, the disclosure of which is incorporated herein by reference in its entirety.

BACKGROUND

1. Field of the Invention

The present invention relates to a feed apparatus for feeding a sheet supported by a support section and an image recording apparatus provided with the feed apparatus.

2. Description of the Related Art

Conventionally, a feed apparatus is known, which has a support section for supporting a sheet so that the sheet supported by the support section is fed, for example, to an image recording apparatus. Some of such feed apparatuses are provided with a support section for supporting sheets in a state in which a plurality of sheets are stacked. In this case, a feed roller abuts against the sheet which is disposed on the uppermost side of the sheets supported by the support section so that the sheet disposed on the uppermost side is fed toward the destination.

In the feed apparatus described above, if the feed roller always abuts against the sheet, any foreign matter such as an oil content or the like, which is contained in the rubber used for the feed roller, adheres to the sheet. The applicant of this application has devised a contact-separating mechanism which brings the feed roller into contact with the sheet and separates the feed roller from the sheet, using a driving force to rotate the feed roller.

When the feed roller rotates in a direction to feed the sheet in a direction for feeding the sheet (i.e. a feed direction), the contact-separating mechanism moves the feed roller to the position at which the feed roller abuts against the sheet. On the other hand, when the feed roller rotates in the direction opposite to the above described direction, the contact-separating mechanism moves the feed roller to a position separated from the sheet. That is, the contact-separating mechanism separates the feed roller from the sheet in a state that the feed apparatus feeds no sheet.

In the feed apparatus provided with the contact-separating mechanism described above, when the feed apparatus is constructed such that the sheet is supported in a state in which the support section is inclined, and the sheet is fed obliquely downwardly in the direction of inclination, then it is feared that sheet may be moved in the feed direction in a state in which the feed roller is separated from the sheet supported by the support section.

Accordingly, it is conceived that a stopper is provided on the downstream side in the feed direction of the sheet supported by the support section. The stopper is positioned at the regulation position at which the stopper abuts against the end portion on the downstream side in the feed direction of the sheet to regulate the movement of the sheet in the feed direction in the state in which the sheet is not fed, i.e., in the state in which the feed roller is separated from the sheet. On the other hand, the stopper is positioned at the retracted position at which the stopper does not abut against the end portion on the downstream side in the feed direction of the sheet in the state in which the sheet is fed, i.e., in the state in which the feed roller abuts against the sheet. That is, the stopper is constructed movably between the regulation position and the retracted position.

When the feed apparatus is provided with the contact-separating mechanism and the stopper as described above, it is feared that the following problem may arise. If the feed roller, which has been separated from the sheet, abuts against the sheet supported by the support section while being rotated in the direction of rotation described above (the feed direction) before the stopper is moved from the regulation position to the retracted position, then the sheet may be fed in the feed direction, and the sheet may be brought in contact with the stopper. Therefore, it is feared that the paper jam may be caused thereby.

SUMMARY

The present teaching has been made taking the foregoing problem into consideration, an object of which is to provide means that makes it possible to avoid the contact between a sheet being fed and a stopper provided to avoid the movement of the sheet when the sheet is not fed.

A feed apparatus according to the present teaching comprises a support unit configured to support a sheet; a feed roller configured to feed the sheet supported by the support unit in a feed direction; an arm configured to be swingable about a swing shaft and configured to rotatably support the feed roller about a shaft different from the swing shaft; a guide unit provided on a downstream side of the support unit in the feed direction, the guide unit having a sheet abutment surface configured to abut against the sheet fed in the feed direction to guide the sheet; a movable member provided for the guide unit and configured to be movable to a protruding position at which the movable member protrudes from the sheet abutment surface and the movable member is able to abut against the sheet supported by the support unit and a retracted position at which the movable member is retracted from the sheet abutment surface, the movable member having a restraining surface configured to abut against the sheet to restrain the sheet; a driving source configured to perform forward rotation and reverse rotation; a first driving transmission unit configured to transmit a rotary driving force from the driving source to an intermediate gear; a second driving transmission unit configured to transmit the rotary driving force from the intermediate gear to the feed roller; a third driving transmission unit configured to transmit the rotary driving force from the intermediate gear to the movable member; and a contact-separating mechanism coupled to the feed roller or the arm and configured to move the feed roller to an abutment position at which the feed roller abuts against the sheet supported by the support unit and a separated position further from the support unit than the abutment position by means of the rotary driving force applied from the second driving transmission unit. The feed roller is rotated in a direction to feed the sheet in the feed direction in a case that the rotary driving force of the forward rotation is applied from the driving source, and the feed roller is rotated in a direction opposite to the direction to feed the sheet in the feed direction in a case that the rotary driving force of the reverse rotation is applied from the driving source. The movable member is shifted from the protruding position to the retracted position in a case that the rotary driving force of the forward rotation is applied from the driving source, and the movable member is shifted from the retracted position to the protruding position in a case that the rotary driving force of the reverse rotation is applied from the driving source. The contact-separating mechanism moves the feed roller from the separated position to the abutment position in a case that the rotary driving force of the forward rotation is applied from the driving source, and the contact-separating mechanism moves the feed roller from the abutment position to the separated position in a case that the rotary driving force of the reverse rotation is applied from the driving source. In a state in which the movable member is disposed at the protruding position and the feed roller is disposed at the separated position, a time required between start of the forward rotation of the driving source and start of feeding of the sheet by the feed roller moved from the separated position to the abutment position, the feed roller being moved by the contact-separating mechanism operated by the rotary driving force of the driving source transmitted to the contact-separating mechanism via the first driving transmission unit, the intermediate gear and the second driving transmission unit, is longer than a time required between the start of the forward rotation of the driving force and a shift of the movable member from the protruding position to the retracted position by the rotary driving force of the driving source transmitted to the movable member via the first driving transmission unit, the intermediate gear and the second driving transmission unit.

According to this construction, the time, which elapses until the feed roller arrived at the abutment position starts the feeding of the sheet after the start of the forward rotation of the driving source in the state in which the movable member is disposed at the protruding position and the feed roller is disposed at the separated position, is longer than the time which elapses until the movable member arrives at the retracted position after the start of the forward rotation of the driving source in the state in which the movable member is disposed at the protruding position and the feed roller is disposed at the separated position. Therefore, the feed roller feeds the sheet supported by the support unit after the movable member is shifted to the retracted position. Accordingly, when the sheet supported by the support unit is fed in the feed direction by the feed roller, it is possible to prevent the sheet from being brought in contact with the movable member.

Another feed apparatus according to the present teaching comprises a support unit provided with a support surface and configured to support a sheet via the support surface; a feed roller configured to feed the sheet supported by the support unit in a feed direction; an arm which is swingable about a swing shaft and configured to rotatably support the feed roller about a shaft different from the swing shaft; a guide unit which is provided on a downstream side of the support unit in the feed direction, the guide section having a sheet abutment surface configured to abut against the sheet fed in the feed direction to guide the sheet; a movable member provided for the guide unit, the movable member being movable to a protruding position at which the movable member protrudes from the sheet abutment surface and the movable member is able to abut against the sheet supported by the support unit and a retracted position at which the movable member is retracted from the sheet abutment surface; a driving source configured to supply a rotary driving force; a first driving transmission unit configured to transmit the rotary driving force from the driving source to the feed roller; a second driving transmission unit configured to transmits the rotary driving force from the driving source to the movable member; and a contact-separating mechanism coupled to the feed roller or the arm and configured to move the feed roller to an abutment position at which the feed roller abuts against the sheet supported by the support unit and a separated position on a side opposite to the support surface in relation to the abutment position in a direction orthogonal to the support surface by means of the rotary driving force applied from the first driving transmission unit. A time required to transmit the rotary driving force from the driving source to the contact-separating mechanism and the feed roller via the first driving transmission unit, shift the feed roller from the separated position to the abutment position, and start a feed of the sheet with the shifted feed roller, after start of a rotation of the driving source is longer than a time required to transmit the rotary driving force from the driving source to the movable member via the second driving transmission unit and shift the movable member at the protruding position to the retracted position, after the start of the rotation of the driving source.

According to the present teaching, the sheet, which is being fed, can be prevented from being brought in contact with the movable member provided to avoid the movement of the sheet when the sheet is not fed.

BRIEF DESCRIPTION OF THE DRAWINGS

FIGS. 11A and 11B depict those disposed around a lower guide member 97 in relation to sectional views taken along a line XI-XI depicted in FIG. 5, wherein FIG. 11A depicts a state in which an abutment member 117 of a movable member 64 is disposed at a retracted position, and FIG. 11B depicts a state in which the abutment member 117 of the movable member 64 is disposed at a protruding position.

FIGS. 12A and 12B depict sectional views taken along a line XII-XII depicted in FIG. 5, wherein FIG. 12A depicts a state in which the swingable member 30 is disposed at a first position and the abutment member 117 of the movable member 64 is disposed at the protruding position, FIG. 12B depicts a state in which the swingable member 30 is disposed at the first position and the abutment member 117 of the movable member 64 is disposed at the retracted position and FIG. 12C depicts a state in which the swingable member 30 is disposed at a second position and the abutment member 117 of the movable member 64 is disposed at the retracted position.

FIGS. 13A and 13B are right side views schematically depicting the bypass tray 71, the feed arm 76 and the swingable member 30, wherein FIG. 13A depicts a state in which the swingable member 30 is disposed at the first position and FIG. 13B depicts a state in which the swingable member 30 is disposed at the second position.

FIGS. 14A and 14B are right side views schematically depicting those disposed around a bypass tray 71, a feed roller 75 and a feed arm 76 in an eighth modified embodiment, wherein FIG. 14A depicts a state in which the feed roller 75 is disposed at the separated position and FIG. 14B depicts a state in which the feed roller 75 is disposed at the abutment position.

DESCRIPTION OF THE PREFERRED EMBODIMENTS

Figure 1:
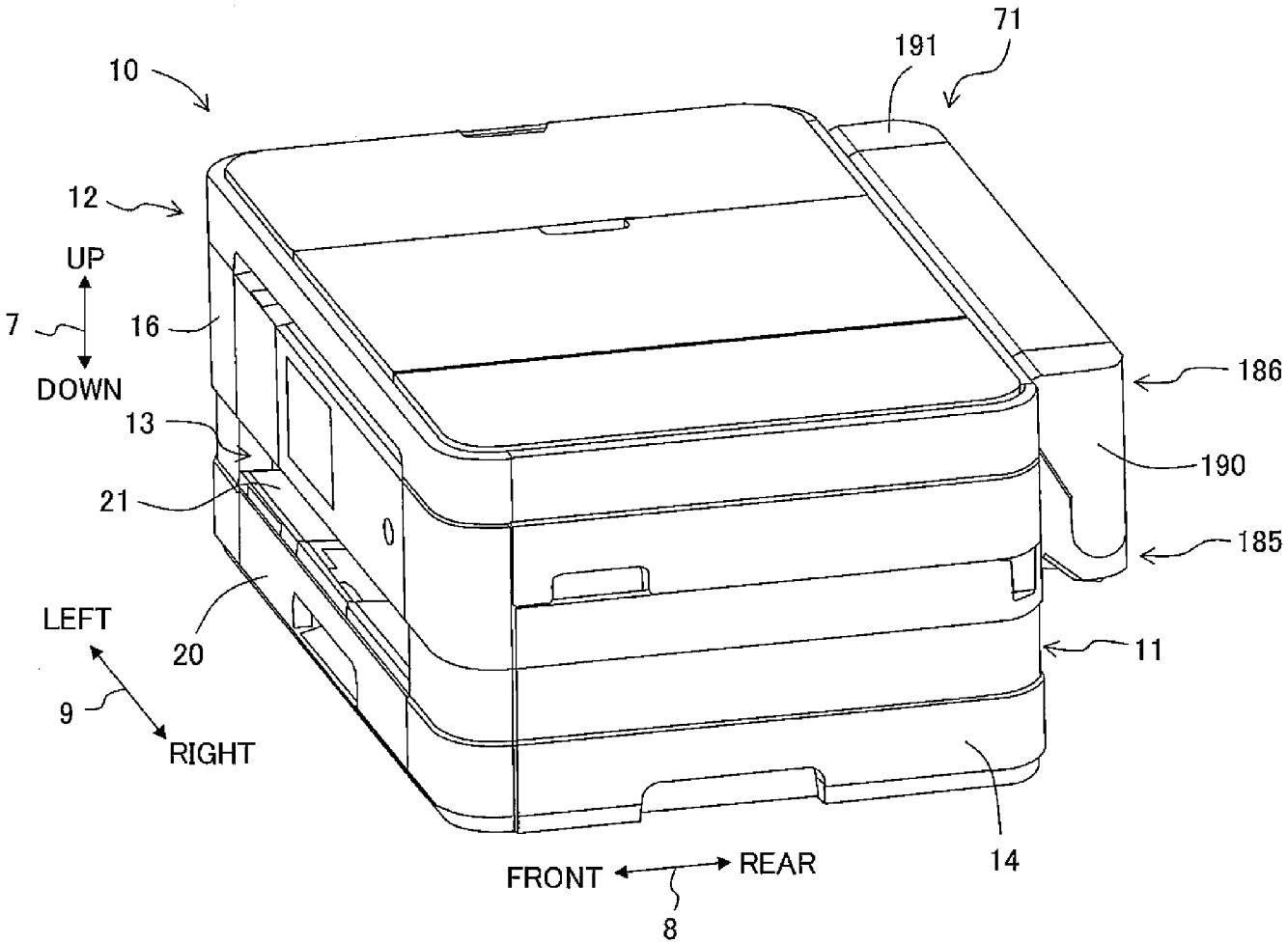
FIG. 1 is a perspective view depicting an appearance of a multifunction peripheral 10 in which a movable unit 186 is in an upstanding state.

An explanation will be made below about a multifunction peripheral 10 according to an embodiment of the present teaching. It goes without saying that the embodiment explained below is merely an example of the present teaching, and the embodiment can be appropriately changed within a range without changing the gist or essential characteristics of the present teaching. Further, in the following explanation, the up-down direction 7 of the multifunction peripheral 10 is defined on the basis of the state (state depicted in FIG. 1) in which the multifunction peripheral 10 is placed to be usable, the front-rear direction 8 of the multifunction peripheral 10 is defined assuming that the side, on which an opening 13 is provided, is the near side (front side), and the left-right direction 9 of the multifunction peripheral 10 is defined while viewing the multifunction peripheral 10 from the near side (front side).

<Overall Construction of Multifunction Peripheral 10>

As depicted in FIG. 1, the multifunction peripheral 10 is formed to have approximately cuboid form, and the multifunction peripheral 10 is provided with a printer unit 11 for recording an image on a sheet such as the recording sheet S in accordance with the ink-jet recording system. The multifunction peripheral 10 has various functions including, for example, the facsimile function and the printing function.

The printer unit 11 has a casing or housing body 14 which has an opening 13 formed on its front surface. A feed tray 20 and a discharge tray 21, which are capable of accommodating the recording sheet S of various sizes, can be inserted into and withdrawn from the casing 14 via the opening 13 in the front-rear direction 8. The bottom surface of the casing 14 abuts against the placement surface on which the multifunction peripheral 10 is placed.

Figure 2:
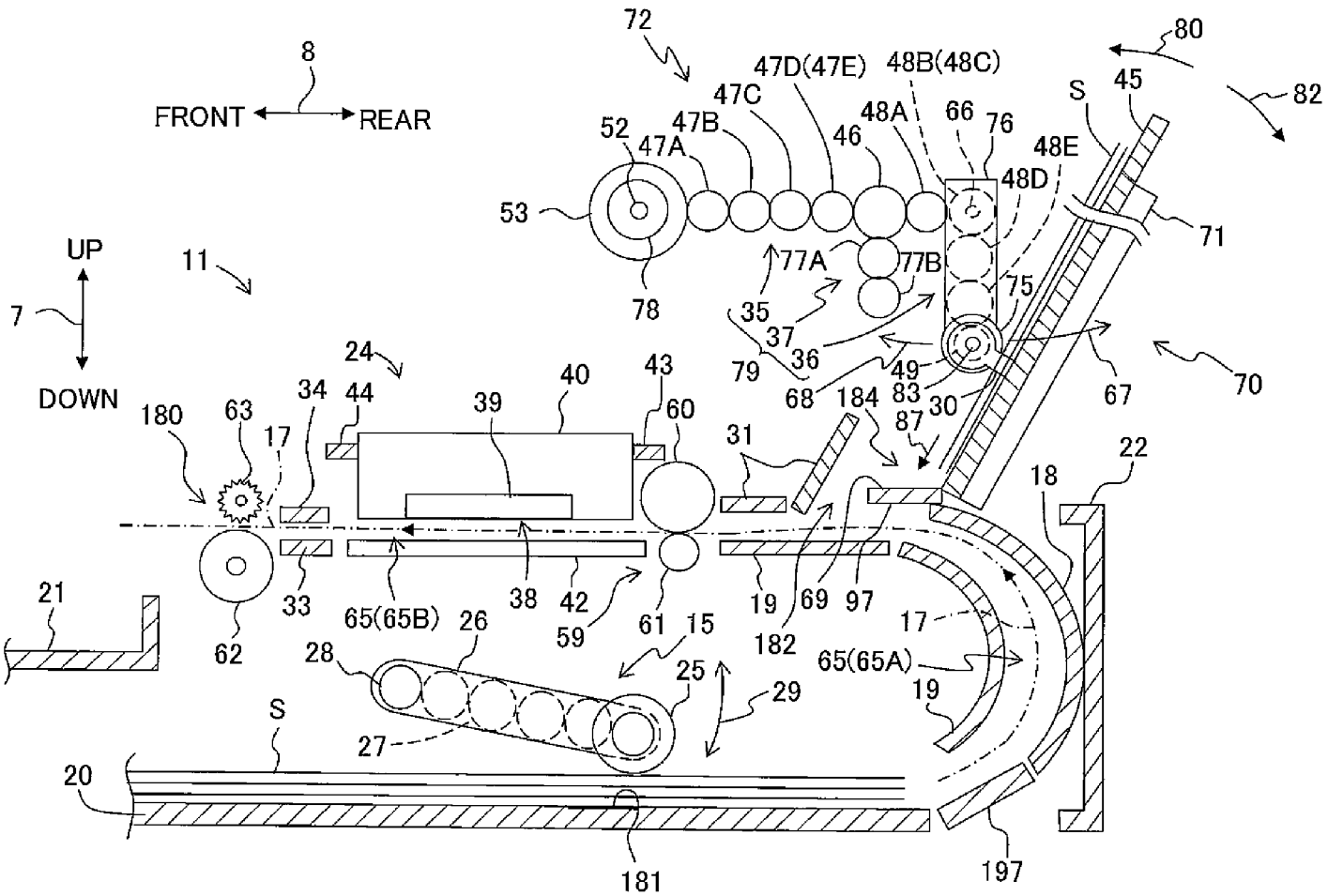
FIG. 2 is a vertical sectional view schematically depicting an internal structure of a printer unit.

As depicted in FIG. 2, the printer unit 11 is provided with, for example, a feed unit 15 for feeding the recording sheet S from the feed tray 20, a recording unit 24 for recording the image on the recording sheet S, a first conveyance roller pair 59 and a second conveyance roller pair 180.

As depicted in FIG. 1, a scanner unit 12 is provided above the printer unit 11. A casing 16 of the scanner unit 12 has the sizes in the front-rear direction 8 and the left-right direction 9 which are the same as those of the casing 14 of the printer unit 11. Therefore, the casing 14 of the printer unit 11 and the casing 16 of the scanner unit 12 are integrated into one unit to form an outer shape of the multifunction peripheral 10 having the approximately cuboid form. The scanner unit 12 is a flatbed scanner. The structure of the flatbed scanner is known, any detailed explanation of which is omitted herein. Further, the scanner unit 12 may be provided with an automatic document feeder (ADF) for picking up a plurality of sheets of manuscript or document one by one and conveying each of the sheets.

<Printer Unit 11>

The structure of the printer unit 11 will be explained in detail below. The printer unit 11 is an example of the image recording apparatus of the present teaching.

<Feed Tray 20>

The feed tray 20 depicted in FIGS. 1 and 2 has such an outer shape that the lengths in the front-rear direction 8 and the left-right direction 9 are longer than the length in the up-down direction 7, and the feed tray 20 has a box-shaped form in which the upper surface is open. The discharge tray 21 is provided on the front side of the upper surface of the feed tray 20. The feed tray 20 can accommodate the recording sheet S by supporting, on the support surface, the recording sheet S having various sizes including, for example, the A4 size based on the Japanese Industrial Standards and the L size used for the photograph recording. The feed tray 20 is installed detachably to the internal space communicated with the opening 13 of the casing 14. The feed tray 20 is movable back and forth in the front-rear direction 8 with respect to the casing 14 via the opening 13.

<Feed Unit 15>

As depicted in FIG. 2, the feed unit 15 is provided with a feed roller 25, a feed arm 26, a driving transmission mechanism 27 and a separation pad 181. The feed unit 15 is provided over or above the feed tray 20 and under or below the recording unit 24. The feed roller 25 is rotatably supported at a forward end portion of the feed arm 26. The feed arm 26 is swingable in the direction of the arrow 29 with a rotational shaft 28 provided at a proximal end portion as the center of swing. Accordingly, the feed roller 25 can make the abutment and the separation with respect to the support surface of the feed tray 20. Therefore, when the feed tray 20 is installed in the casing 14 while accommodating the recording sheet S, the feed roller 25 can abut against the recording sheet S accommodated in the feed tray 20. The separation pad 181 is provided at the position at which the feed roller 25 abuts against the support surface of the feed tray 20 when the feed tray 20, which accommodates no recording sheet S, is installed in the casing 14. The separation pad 181 is formed of a material having a frictional coefficient with respect to the recording sheet S which is larger than a frictional coefficient with respect to the recording sheet S of the support surface of the feed tray 20.

The driving force of a motor (not depicted) is transmitted to the feed roller 25 via the driving transmission mechanism 27. The driving transmission mechanism 27 transmits the rotation transmitted to the rotational shaft 28 to the shaft of the feed roller 25 by means of an endless belt, a gear train etc. When the feed roller 25 is rotated in a state in which the feed roller 25 abuts against the recording sheet S disposed on the uppermost side of the recording sheets S supported on the support surface of the feed tray 20, the uppermost recording sheet S is thereby fed toward a conveyance path 65. When the recording sheet S is fed toward the conveyance path 65, the forward end of the recording sheet S abuts against a separation member 197 provided on the back side in the front-rear direction 8 of the feed tray 20. As a result, only the recording sheet S, which is disposed on the uppermost side, is conveyed while being separated from the recording sheets S which are disposed on the lower side. The recording sheets S, which are disposed on the lower side of the recording sheets S disposed at the uppermost side, are retained in the feed tray 20 without being dragged by the recording sheet S which is disposed on the uppermost side.

<Conveyance Path 65>

As depicted in FIG. 2, the conveyance path 65, which is provided in the internal space of the casing 14, extends while being curved to make a U-turn upwardly from the back side of the feed tray 20. Further, the conveyance path 65 is bent frontwardly from the back side of the printer unit 11. After that, the conveyance path 65 further extends substantially in a straight line toward the front side of the printer 11 to arrive at the discharge tray 21. The conveyance path 65 is roughly classified into a curved passage 65A which makes the U-turn and a straight passage 65B which is straight.

The curved passage 65A is defined by an outer guide member 18, an inner guide member 19 and a guide member 31. The outer guide member 18 and the inner guide member 19, the inner guide member 19 and the guide member 31, and the guide member 31 and the outer guide member 18 are respectively opposed to each other while being separated by the space through which the recording sheet S can pass. The straight passage 65B is defined, for example, by the recording unit 24, a platen 42, a guide member 34 and a guide member 33. The recording unit 24 and the platen 42 are opposed to each other while being separated by the space through which the recording sheet S can pass, and the guide member 34 and the guide member 33 are opposed to each other while being separated by the space through which the recording sheet S can pass.

The recording sheet S, which is fed to the conveyance path 65 by the feed roller 25 of the feed tray 20, is conveyed along the curved passage 65A from the lower side to the upper side. In this procedure, the conveyance direction 17 is reversed from the backward direction to the forward direction. After that, the recording sheet S is conveyed from the back side to the front side without reversing the conveyance direction 17 through the straight passage 65B.

The outer guide member 18 constitutes the outer guide surface of the curved passage 65A when the recording sheet S is conveyed via the curved passage 65A. The inner guide member 19 constitutes the inner guide surface of the curved passage 65A when the recording sheet S is conveyed via the curved passage 65A. Each of the guide surfaces may be constructed by one surface, or each of the guide surfaces may be constructed as an enveloping surface of forward ends of a plurality of ribs.

The guide member 31 is arranged over or above the inner guide member 19 just upstream from (on the back side of) the first conveyance roller pair 59. The outer guide member 18 and the guide member 31 also define a bypass route 182 described later on.

<Back Surface Cover 22>

As depicted in FIG. 2, the back surface cover 22 constructs a part of the back surface of the casing 14 while supporting the outer guide member 18. The back surface cover 22 is swingably supported with respect to the casing 14 at its both right and left ends on the lower side. When the back surface cover 22 is swung so that its upper side is allowed to incline backwardly about the rotational shaft provided in the left-right direction 9 on the lower side, a part of the conveyance path 65 and a part of the bypass route 182 described later on are thereby released (exposed) to the outside of the casing 14.

The outer guide member 18 is also swingably supported with respect to the casing 14 at the both left and right ends on the lower side in the same manner as the back surface cover 22. The outer guide member 18 is also swingable so that the upper side thereof is allowed to incline backwardly about the rotational shaft in the left-right direction 9 on the lower side in a state in which the back surface cover 22 is swung so that the back surface cover 22 is allowed to incline backwardly. When the outer guide member 18 is swung so that the outer guide member 18 is allowed to incline backwardly, at least a part of the curved passage 65A is thereby released (exposed). As depicted in FIG. 2, when the back surface cover 22 is closed to provide the upstanding state, then the outer guide member 18 is maintained in the upstanding state while being supported by the back surface cover 22 from the back, and the outer guide member 18 is opposed to the inner guide member 19 to define a part of the curved passage 65A.

<First Conveyance Roller Pair 59 and Second Conveyance Roller Pair 180>

As depicted in FIG. 2, the first conveyance roller pair 59 is provided on the upstream side of the recording unit 24 in the conveyance direction 17 of the recording sheet S along the conveyance path 65. The first conveyance roller pair 59 has a first conveyance roller 60 and a pinch roller 61. Similarly, the second conveyance roller pair 180 is provided on the downstream side of the recording unit 24 in the conveyance direction 17. The second conveyance roller pair 180 has a second conveyance roller 62 and a spur roller 63. The first conveyance roller 60 and the second conveyance roller 62 are rotated by transmitting the rotation of the motor (not depicted). When the first conveyance roller 60 and the second conveyance roller 62 are rotated in a state in which the recording sheet S is interposed between the respective rollers for constructing the first conveyance roller pair 59 and the second conveyance roller pair 180 respectively, the first conveyance roller pair 59 and the second conveyance roller pair 180 thereby transport the recording sheet S in the conveyance direction 17 along the conveyance path 65.

<Recording Unit 24>

As depicted in FIG. 2, the recording unit 24 is provided between the first conveyance roller pair 59 and the second conveyance roller pair 180. The recording unit 24 is provided with a carriage 40 and a recording head 39. The carriage 40 is supported by guide rails 43, 44 provided on the back side and the front side of the platen 42 so that the carriage 40 is reciprocatively movable in the left-right direction 9. A known belt mechanism is provided for the guide rail 44. The carriage 40 is coupled to an endless belt of the belt mechanism. The carriage 40 is reciprocatively moved in the left-right direction 9 along the guide rails 43, 44 in accordance with the rotation of the endless belt. When the carriage 40 and the recording head 39 are opposed to the platen 42 with the space intervening therebetween, the carriage 40, the recording head 39 and the platen 42 define a part of the straight passage 65B.

The recording head 39 is carried on the carriage 40. A plurality of nozzles 38 are formed on the lower surface of the recording head 39. Inks are supplied from ink cartridges (not depicted) to the recording head 39. The recording head 39 selectively discharges the inks as minute ink droplets from the plurality of nozzles 38. The ink droplets are discharged to the recording sheet S supported by the platen 42 from the nozzles 38 when the carriage 40 is moved in the left-right direction 9. The discharged ink droplets adhere to the recording sheet S on the platen 42, and thus an image is recorded on the recording sheet S.

<Bypass Route 182>

As depicted in FIG. 2, the opening 184 is provided over or above the back surface cover 22 at the back surface of the casing 14. The bypass route 182, which extends from the opening 184 to the first conveyance roller pair 59, is formed in the casing 14. The bypass route 182 extends from the upper backward to the lower frontward in the casing 14. The bypass passage 182 is defined, for example, by the guide member 31, the outer guide member 18 and the back surface cover 22. The guide member 31 constructs the guide surface on the upper side when the recording sheet S is conveyed via the bypass route 182. The outer guide member 18 and the back surface cover 22 construct the guide surface on the lower side when the recording sheet S is conveyed via the bypass route 182. Both of the curved passage 65A and the straight passage 65B of the conveyance path 65 are arranged under or below the bypass route 182. A part of the bypass route 182 is released (exposed) to the outside of the casing 14 together with a part of the conveyance path 65 in accordance with the swing of the outer guide member 18 and the back surface cover 22 so that their upper sides are allowed to incline backwardly.

The recording sheet S, which is accommodated in the bypass tray 71 described later on, is guided obliquely downwardly along the bypass route 182. The recording sheet S is guided along the straight passage 65B of the conveyance path 65, and the recording sheet S is conveyed by the first conveyance roller pair 59. Further, the image recording is performed on the recording sheet S by the recording unit 24, and the recording sheet S is discharged to the discharge tray 21. In this way, the recording sheets S, which are accommodated in the bypass tray 71, are each conveyed via the route having the substantially straight shape (route in which the front surface and the back surface of the recording sheet S are not reversed in the up-down direction 7).

<Feed Apparatus 70>

Figure 9B:
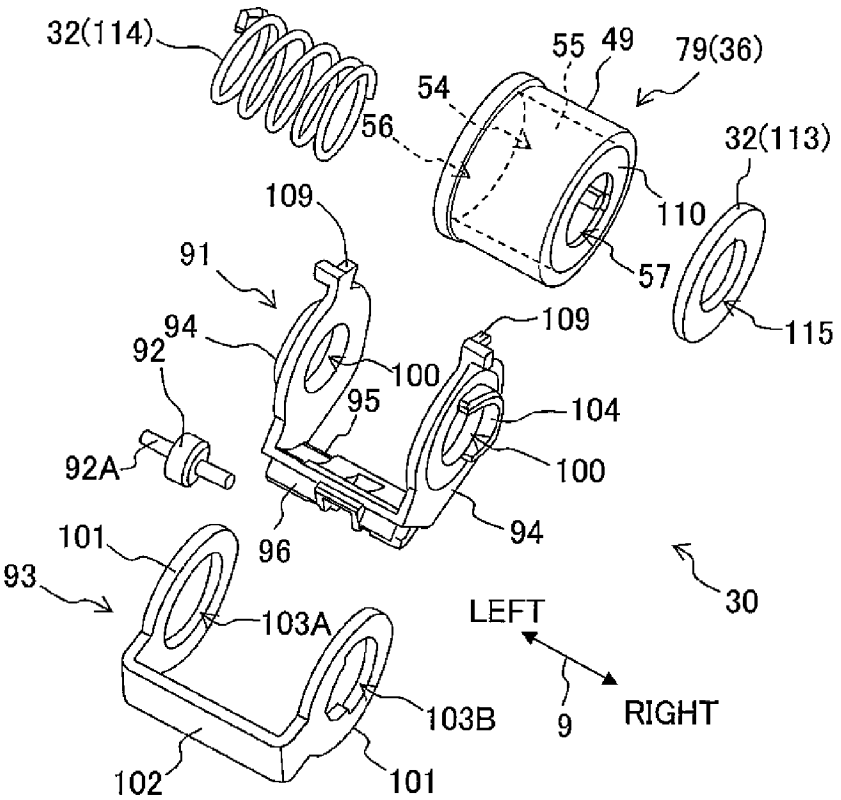
FIG. 9B is an exploded perspective view depicting those depicted in FIG. 9A.

The printer unit 11 is provided with the feed apparatus 70. The feed apparatus 70 is constructed by the bypass tray 71 and a feed unit 72. As depicted in FIG. 2, the feed unit 72 is provided with feed rollers 75 (example of the feed roller of the present teaching), a feed arm 76 (example of the arm of the present teaching), a feeding motor 78 (example of the driving source of the present teaching), the driving transmission mechanism 79 and the swingable member 30. The contact-separating mechanism of the present teaching is constructed by the swingable member 30, the first regulating section 107 (FIG. 13), the second regulating section 108 (FIG. 13) and the torque limiter 32 (FIG. 9B).

<Bypass Tray 71>

Figure 4:
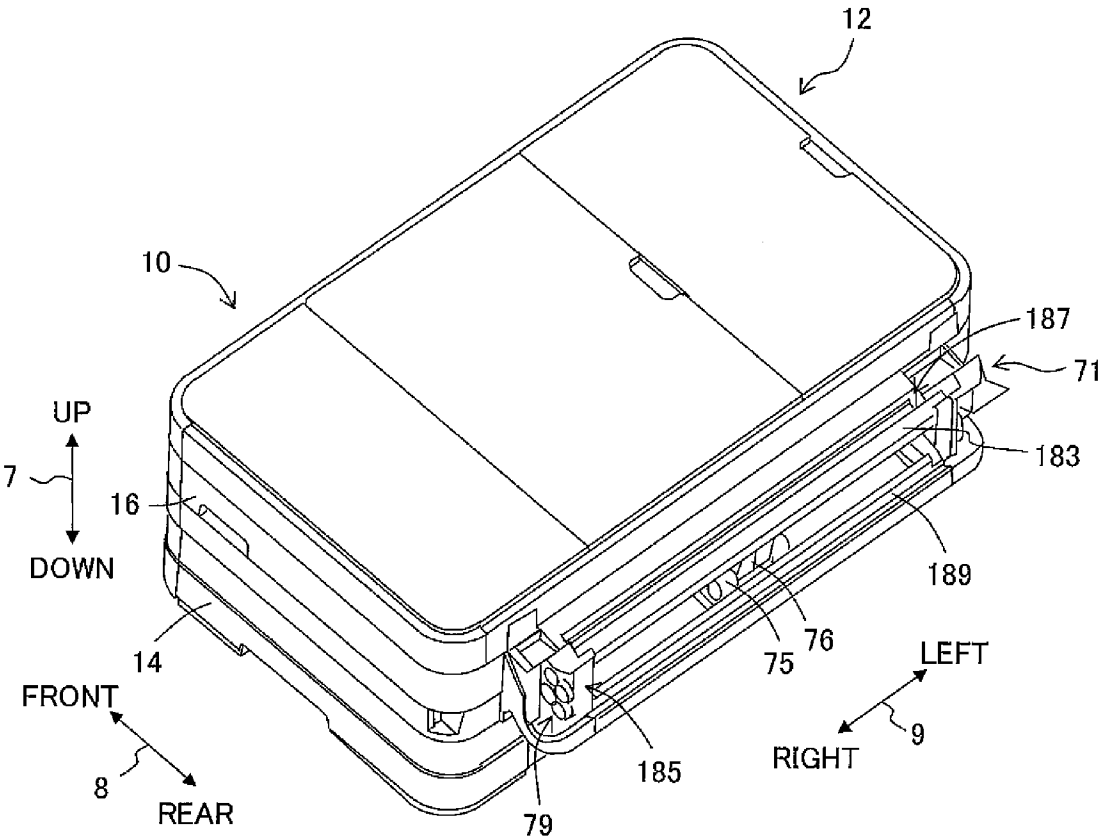
FIG. 4 is a perspective view depicting an appearance on a back surface side of the multifunction peripheral 10 in a state in which the movable unit 186 is removed.

As depicted in FIGS. 1 and 4, the bypass tray 71 is provided on the back surface side of the multifunction peripheral 10. The bypass tray 71 accommodates the recording sheet S independently from the feed tray 20.

Figure 3:
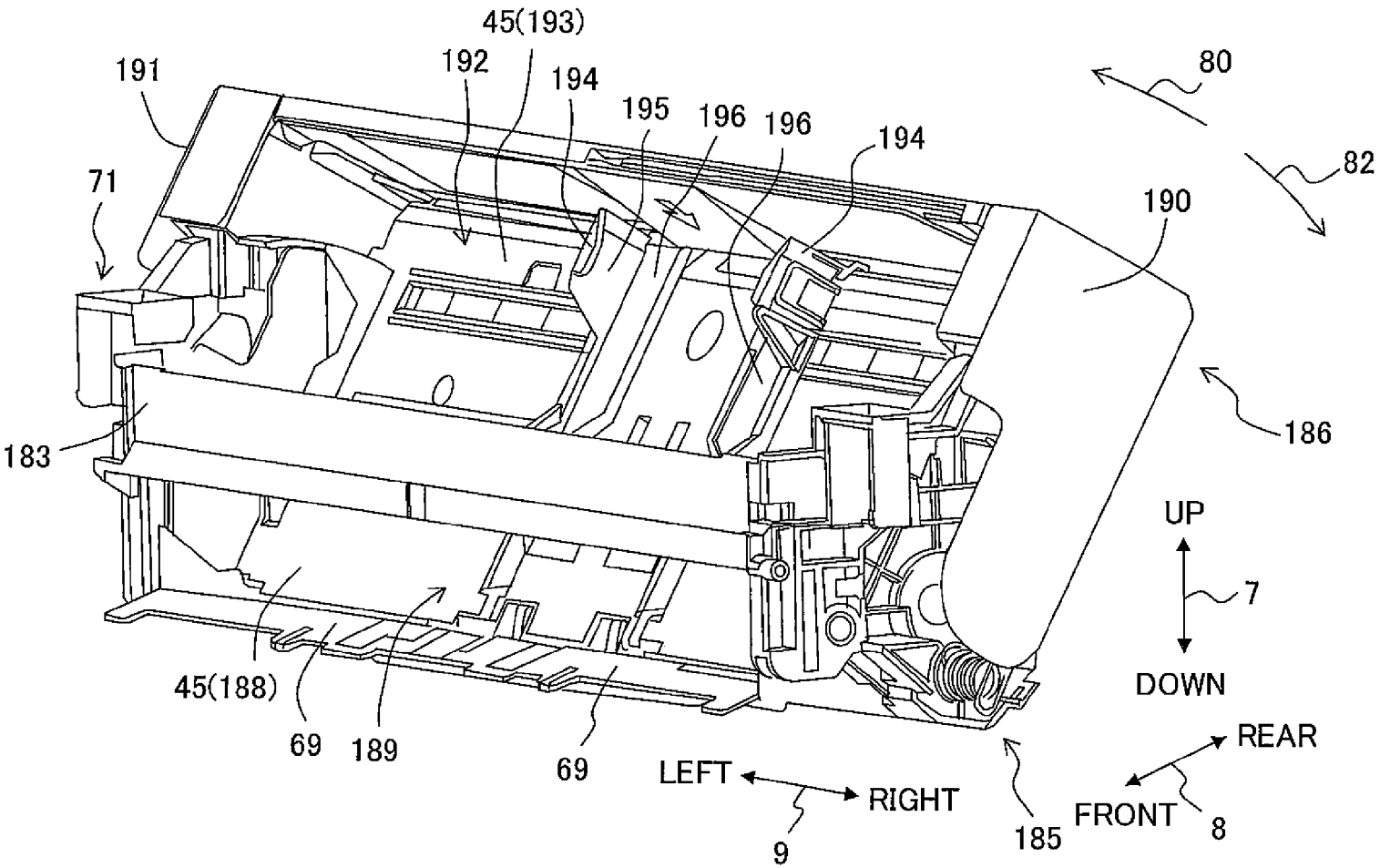
FIG. 3 is a perspective view depicting a bypass tray 71 in which the movable unit 186 is in a inclined state.

As depicted in FIGS. 1 and 3, a fixed unit 185, which extends downwardly so that the opening 184 (see FIG. 2) is covered therewith, is provided on the back surface side of the casing 16 of the scanner unit 12. The fixed unit 185 constitutes a part of the bypass tray 71 disposed on the downstream side in the conveyance direction 17. As depicted in FIG. 3, a movable unit 186 is provided on the upper side of the fixed unit 185 so that the movable unit 186 is swingable in the directions of the arrows 80, 82 with respect to the fixed unit 185. The bypass tray 71 is constructed by the fixed unit 185 and the movable unit 186.

As depicted in FIG. 4, a slit-shaped opening 187, which extends in the left-right direction 9, is formed on the upper surface of the fixed unit 185. In the bypass tray 71, a passage is formed via the opening 187 to arrive at the bypass route 182 (see FIG. 2). As depicted in FIG. 3, a support member 189, which has a support surface 188, is provided for the fixed unit 185. The support surface 188 extends obliquely downwardly to the bypass route 182 (see FIG. 2). The lower end of the support member 189 forms a part of the guide surface for guiding the recording sheet S conveyed along the bypass route 182.

As depicted in FIG. 3, a reinforcing member 183, which rotatably supports a rotational shaft 66 of the feed arm 76 (see FIG. 6), is provided over or above the support surface 188 on the upper end side of the support member 189. The rotational shaft 66 constructs a part of the driving transmission mechanism 79, and the rotational shaft 66 is rotated by transmitting the rotary driving force from the feeding motor 78 (see FIG. 2). The driving transmission mechanism 79 will be explained in detail later on.

The feed arm 76 is swingably supported by the rotational shaft 66. That is, the feed arm 76 is swingable about the rotational shaft 66. The feed rollers 75 are rotatably supported on the forward end side of swing movement of the feed arm 76. The feed arm 76 is allowed to extend downwardly from the rotational shaft 66 toward the support surface 188 of the support member 189. The feed arm 76 is arranged at the center in the left-right direction 9 of the fixed unit 185. The construction of the feed arm 76 will be described in detail later on.

Figure 6:
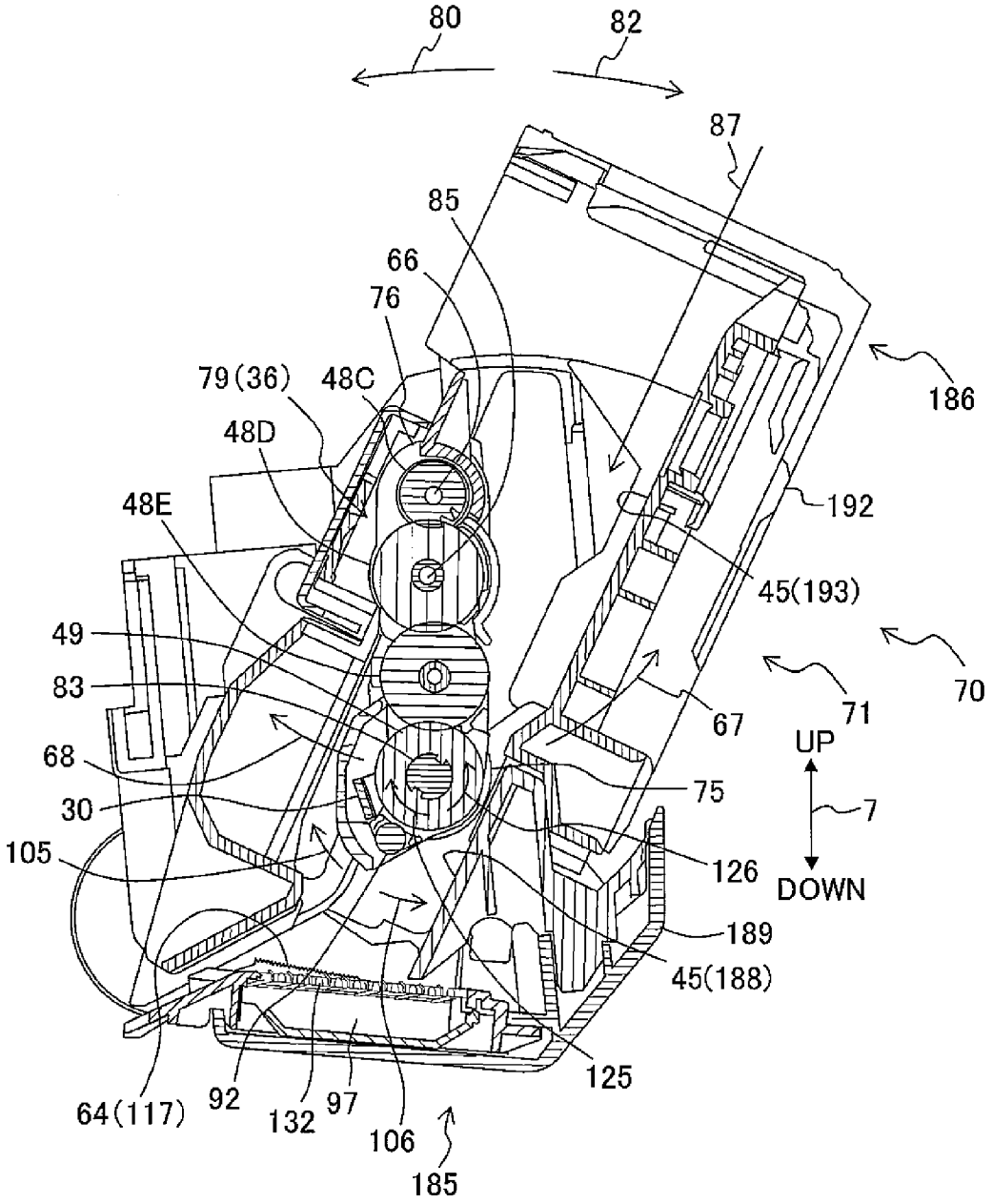
FIG. 6 is a sectional view taken along a line VI-VI depicted in FIG. 5.

The feed rollers 75 are coupled to the rotational shaft 66 by a plurality of gears 48C, 48D, 48E, 49 (see FIG. 6). The rotation of the rotational shaft 66 is transmitted to the feed rollers 75 by the plurality of gears 48C, 48D, 48E, 49, and the feed rollers 75 are rotated. The feed rollers 75 are rotated in a state in which the feed rollers 75 abut against the recording sheet S disposed on the uppermost side of the recording sheets S supported by the support surface 188 of the bypass tray 71, and thus the recording sheet S, which is disposed on the uppermost side, is fed in the feed direction 87 (one direction from the bypass tray 71 to the discharge tray 21. See FIGS. 2 and 6) via the bypass route 182 (see FIG. 2). The recording sheets S, which are disposed on the lower side of the recording sheet S disposed at the uppermost side, are disentangled or unraveled by the separation member 132 of the lower guide member 97 described later on, and the recording sheets S are retained in the bypass tray 71 without being dragged by the recording sheet S disposed on the uppermost side. In this way, the feed unit 72, which is constructed, for example, by the feed rollers 75, the rotational shaft 66 and the feed arm 76, is arranged in the space disposed over or above the support surface 188 at the outside of the casing 14. The construction of the feed rollers 75 will be described in detail later on.

As depicted in FIGS. 3 and 6, the movable unit 186 is provided swingably with respect to the fixed unit 185 on the upper side of the fixed unit 185. The movable unit 186 is swingable between the upstanding state in which the movable unit 186 is upstanding in the up-down direction 7 as depicted in FIG. 1 and the inclined or laid-down state in which the movable unit 186 is inclined with respect to the up-down direction 7 as depicted in FIG. 3.

The upstanding state is the state which is provided to decrease the space for the movable unit 186 on the back surface side of the casing 14, and the upstanding state is the state in which the bypass tray 71 is not used. The back surface of the movable unit 186 in the upstanding state is substantially parallel to the back surface of the casing 14. As for the movable unit 186 in the upstanding state, the forward end of swing movement is positioned upwardly as compared with the proximal end of swing movement. The inclined state is the state in which the movable unit 186 is inclined obliquely upwardly toward the outside of the casing 14, and thus the inclined support surfaces 188, 198 are substantially provided as one flat surface, and the inclined state is the state in which the bypass tray 71 can be used. As for the movable unit 186 in the inclined state, the forward end of swing movement is separated from the back surface of the casing 14 as compared with the proximal end of swing movement. Whether the movable unit 186 is in the upstanding state or in the inclined state can be selected in accordance with the operation of a user.

As depicted in FIG. 3, side walls 190, 191 are provided on the both sides in the left-right direction 9 of the movable unit 186. The side walls 190, 191 cover parts on the both sides in the left-right direction 9 of the fixed unit 185. The driving transmission mechanism 79, which is provided on the left side in the left-right direction 9 of the fixed unit 185, is covered with the side wall 190 of the movable unit 186.

As depicted in FIG. 3, a support member 192 is provided to span the side walls 190, 191 of the movable unit 186. In the inclined state, a support surface 193, which is provided on the upper surface of the support member 192, forms substantially the same plane (flat surface) with respect to the support surface 188. In other words, the recording sheet S is supported by the flat surface 45 which is formed by the support surface 188 of the support member 189 and the support surface 193 of the support member 192 in the bypass tray 71 in which the movable unit 186 is in the inclined state. In other words, the support members 189, 192 are examples of the support unit of the present teaching. Further, when the movable unit 186 is in the upstanding state, the support surface 193 is orthogonal to the placement surface of the multifunction peripheral 10, i.e., the support surface 193 is in the state in which the support surface 193 extends in the up-down direction 7 and the left-right direction 9. In this embodiment, the placement surface, on which the multifunction peripheral 10 is placed, is the surface which is spread in the left-right direction 9 and the front-rear direction 8. In this context, the term "substantially one flat surface (same flat surface)" refers to the flat surface on which the supported recording sheet S is neither bent nor flexed even when there is a small difference in height between two surfaces constituting the flat surface, i.e., the flat surface on which the recording sheet S is supported so that separation performance is stably obtained by the separation member 132 as described later on.

As depicted in FIG. 3, a pair of side guides 194 are provided for the support member 192. The pair of side guides 194 are provided while being separated from each other in the left-right direction 9, and the pair of side guides 194 are allowed to protrude upwardly from the support surface 193. The side guide 194 has a guide surface 195 which is allowed to extend in the feed direction 87 of the bypass tray 71. When the recording sheet S on the support surface 193 is transported, the side edges of the recording sheet S in the feed direction 87 are guided by the guide surfaces 195.

The side guide 194 has a support surface 196 which extends along the support surface 193 of the support member 192. In other words, the side guide 194 has a substantially L-shaped form in which the guide surface 195 and the support surface 196 are orthogonal to one another. Although a slight difference in height exists between the support surface 196 and the support surface 193, the support surface 196 and the support surface 193 form substantially the same flat surface to support the recording sheet S together with the support surfaces 188, 193. The distance, by which the pair of side guides 194 are separated from each other in the left-right direction 9, is variable. Accordingly, the side edges of the recording sheet S having various sizes supported by the support surfaces 193, 196 can be guided by the guide surfaces 195 of the side guides 194.

<Feed Roller 75 and Feed Arm 76>

As depicted in FIG. 6, the feed rollers 75 are arranged opposingly to the support surface 188 of the fixed unit 185.

Figure 7:
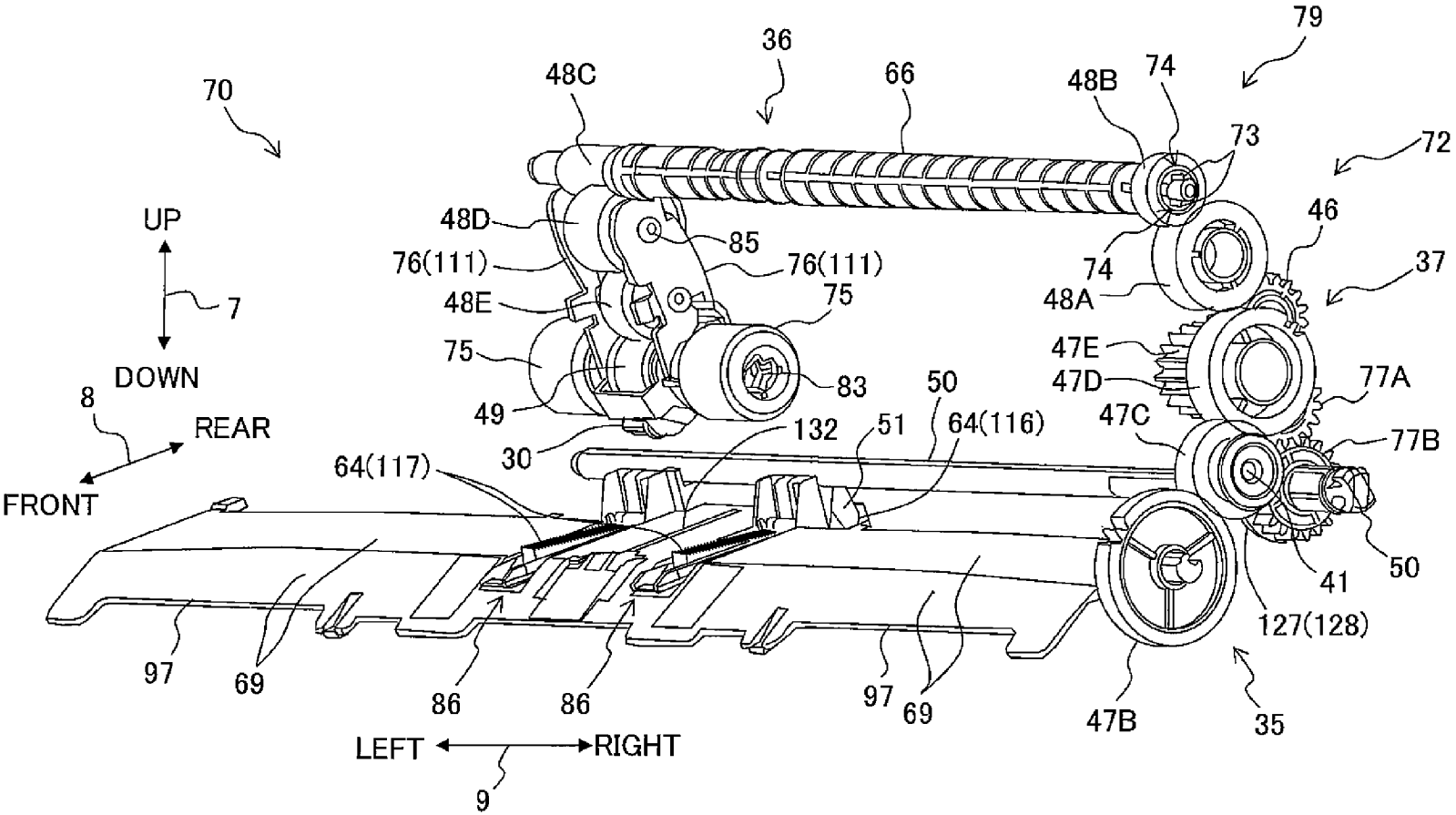
FIG. 7 is a perspective view depicting the feed apparatus 70.

As depicted in FIG. 7, the rotational shaft 83 of the feed rollers 75 extends in the left-right direction 9. The two feed rollers 75 are provided with a spacing distance intervening therebetween in the left-right direction 9. In other words, the feeding apparatus 70 is provided with the pair of feed rollers 75. Further, the pair of feed rollers 75 are arranged with a spacing distance intervening therebetween in the axial direction of the rotational shaft 83 which is a rotational shaft common to the two feed rollers 75, i.e., in the left-right direction 9.

Figure 8:
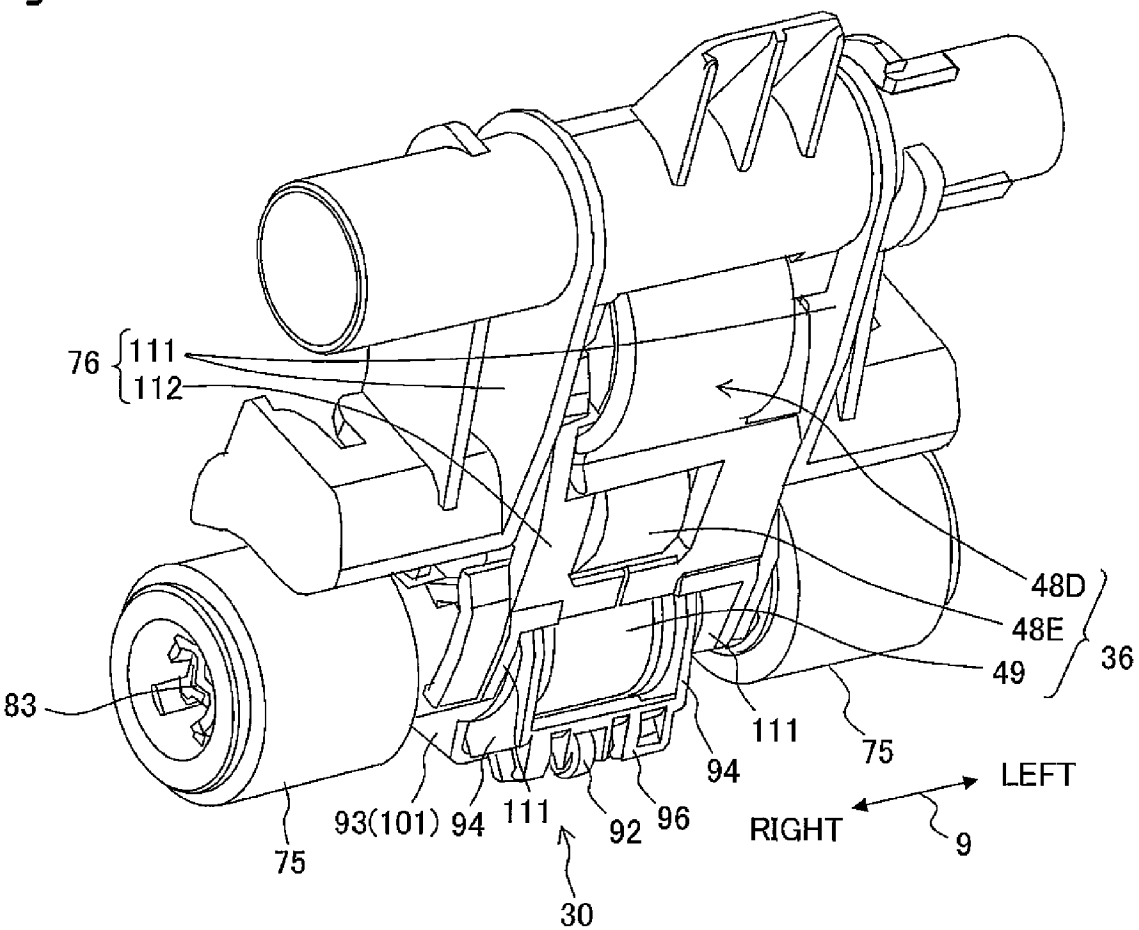
FIG. 8 is a perspective view depicting those disposed around a feed arm 76.

As depicted in FIG. 8, the feed arm 76 is provided with a pair of side plates 111 and a connecting plate 112 which connects the pair of side plates 111. The pair of side plates 111 extend, from its one end, toward upstream side in the feed direction 87 (see FIGS. 2 and 6) and in the direction away from the flat surface 45.

The right feed roller 75, which is included in the pair of feed rollers 75, is supported rotatably at the one end of the right side plate 111. The left feed roller 75, which is included in the pair of feed rollers 75, is supported rotatably at the one end of the left side plate 111.

As depicted in FIG. 7, the upstream-side end in the feed direction 87 of the pair of side plates 111, i.e., the other end of the feed arm 76 is swingably supported by the rotational shaft 66 provided for a second driving transmission unit 36. Accordingly, the feed arm 76 is swingable with the rotational shaft 66 as a swing center. In other words, the feed arm 76 is swingable with the other end as the swing shaft. As a result, the feed rollers 75 can make abutment and separation with respect to the flat surface 45 or the recording sheet S supported by the flat surface 45.

The feed arm 76 and the rotational shaft 66 are coupled to one another by a torsion spring (not depicted). Accordingly, as depicted in FIG. 6, the feed arm 76 is urged in the direction of the arrow 67, i.e., toward the side of the flat surface 45 of the bypass tray 71 by the torsion spring. The mechanism or construction, in which the feed arm 76 is urged in the direction of the arrow 67, is not limited to the mechanism or construction in which the torsion spring is provided. For example, it is also allowable that a coil spring, which has one end connected to the feed arm 76 and which has the other end connected to the frame of the printer unit 11, is arranged on the front side of the feed arm 76. Even in the case of this construction, the feed arm 76 is urged by the coil spring in the direction of the arrow 67.

<Lower Guide Member 97>

As depicted in FIG. 6, the lower guide member 97 (example of the guide unit of the present teaching) is provided on the downstream side of the support member 189 of the bypass tray 71 in the feed direction 87. The upper surface 69 (example of the sheet abutment surface of the present teaching) of the lower guide member 97 is inclined with respect to the support surface 188 (flat surface 45). The upper surface 69 of the lower guide member 97 is positioned at approximately the same height as that of the opening 184 (see FIG. 2) in the up-down direction 7.

When the feeding of the recording sheet S is started in the feed direction 87 by the feed rollers 75, the lower guide member 97 guides the forward end of the recording sheet S abutting against the lower guide member 97 along the upper surface 69. The separation member 132 (see FIGS. 6 and 7), which has a plurality of teeth allowed to protrude upwardly from the upper surface 69 and aligned in the front-rear direction 8, is provided at the central portion in the left-right direction 9 of the upper surface 69 of the lower guide member 97. The forward ends of the plurality of recording sheets S supported by the bypass tray 71 are disentangled or unraveled by the teeth. Even when the forward ends of the plurality of recording sheets S are guided by the feed rollers 75 along the upper surface 69, the separation member 132 separates the recording sheet S which is disposed at the uppermost side and which abuts against the feed rollers 75 from the other recording sheets S. As a result, the feed rollers 75 feed only the recording sheet S disposed at the uppermost side toward the bypass route 182.

As depicted in FIG. 7, a pair of recesses 86, which extend in the front-rear direction 8, are provided on the upper surface 69 of the lower guide member 97. The recesses 86 are provided on the right and the left of the separation member 132 respectively in the left-right direction 9. That is, the separation member 132 is arranged approximately at the center of the pair of recesses 86 in the left-right direction 9. Movable members 64 are arranged in the recesses 86 as described later on. As depicted in FIG. 11, the recess 86 is defined by a bottom surface 84, a first side surface 122 (example of the retraction regulating section of the present teaching) and a second side surface 123 (example of the protrusion regulating section of the present teaching).

<Driving Transmission Mechanism 79>

The feeding motor 78 (see FIG. 2), which is rotatable forwardly and reversely, is provided for the printer unit 11. Further, as depicted in FIGS. 2 and 7, the driving transmission mechanism 79, which is composed of a plurality of gears meshed with each other, is provided in the printer unit 11. However, in FIG. 2, the rotational shaft 50 and those arranged thereafter in a third driving transmission unit 37 are omitted from drawing. Further, in FIG. 7, the gear 47A and those arranged thereafter in a first driving transmission unit 35 are omitted from drawing. The rotary driving force, which is generated by the forward rotation and the reverse rotation performed by the feeding motor 78, is transmitted to the feed rollers 75 and the movable member 64 via the driving transmission mechanism 79.

As depicted in FIGS. 2 and 7, the driving transmission mechanism 79 is provided with the first driving transmission unit 35, the second driving transmission unit 36, the third driving transmission unit 37 and an intermediate gear 46.

As depicted in FIG. 7, the first driving transmission unit 35 is arranged on the right side of the bypass tray 71 (see FIG. 4) and the lower guide member 97 in the left-right direction 9. As depicted in FIG. 2, the first driving transmission unit 35 is provided with five gears 47A, 47B, 47C, 47D, 47E. The four gears 47A, 47B, 47C, 47D constitute a gear train in which they are meshed with each other. The gear 47A, which is arranged at one end of the gear train, is meshed with a driving gear 53 which is attached to a rotational shaft 52 of the feeding motor 78.

The gears 47D, 47E are arranged at the other end of the gear train. The gears 47D, 47E are arranged while being aligned in the thrust direction, and they are rotated integrally about the same rotational shaft. The gear 47D is meshed with the gear 47C. The gear 47E is meshed with the intermediate gear 46. According to the above, the first driving transmission unit 35 transmits the rotary driving force from the feeding motor 78 to the intermediate gear 46.

As depicted in FIG. 7, the second driving transmission unit 36 is provided with five gears 48A to 48E, a roller gear 49 and a rotational shaft 66. The gears 48A, 48B are meshed with each other. The rotational shaft 66 is provided to extend in the left-right direction 9 from the right of the bypass tray 71 and the lower guide member 97 approximately to the central portion in the left-right direction 9 of the bypass tray 71 and the lower guide member 97. The gear 48A is meshed with the intermediate gear 46. The gear 48B is coupled to the right end of the rotational shaft 66. The gear 48B is rotatable integrally with the rotational shaft 66, and the gear 48B is also rotatable independently from the rotational shaft 66. The coupling of the gear 48B and the rotational shaft 66 will be described later on.

The gears 48C to 48E constitute a gear train in which they are meshed with each other. The gear 48C, which is arranged at one end of the gear train, is attached to the left end of the rotational shaft 66, and the gear 48C is rotatable integrally with the rotational shaft 66. The gear 48E, which is arranged at the other end of the gear train, is meshed with the roller gear 49. The gears 48D, 48E are rotatably supported by the feed arm 76. In other words, the second driving transmission unit 36 is provided with the gear train supported by the feed arm 76 in which the gears are meshed with each other. The roller gear 49 is attached to the rotational shaft 83 of the feed roller 75 between the pair of feed rollers 75, and the roller gear 49 is rotatable integrally with the rotational shaft 83.

According to the above, the second driving transmission unit 36 transmits the rotary driving force from the intermediate gear 46 to the feed rollers 75. The feed rollers 75, to which the rotary driving force of the forward rotation is transmitted from the feeding motor 78 via the second driving transmission unit 36, is rotated so that the recording sheet S, which is supported by the flat surface 45 of the bypass tray 71, is fed in the feed direction 87.

As depicted in FIG. 9, the roller gear 49 is provided with a recess 54 which extends in the left-right direction 9 as the axial direction of the roller gear 49. The recess 54 is defined by an inner side surface 55 and a bottom surface 110 of the roller gear 49. A compression coil spring 114 is arranged in the recess 54 as described later on. An opening 56 is formed on the surface of the roller gear 49 opposed to the bottom surface 110. Further, an opening 57, which has a diameter smaller than that of the opening 56, is formed on the bottom surface 110 of the roller gear 49. The rotational shaft 83 of the feed rollers 75 penetrates through the roller gear 49 via the openings 56, 57.

As depicted in FIG. 7, keys 73, which protrude in the radial directions of the rotational shaft 66, are provided at the right end of the rotational shaft 66. A through-hole, into which the rotational shaft 66 can be inserted, is provided at the central portion of the gear 48B. Further, substantially sector-shaped key grooves 74, within which the keys 73 can be fitted or inserted, are provided at positions corresponding to the keys 73 in the through-hole. In the circumferential direction of the gear 48B, the length of the circular arc of the key groove 74 is designed to be longer than the length in the circumferential direction of the key 73. Accordingly, if the key groove 74 does not abut against the key 73 during the rotation of the gear 48B, the gear 48B idles with respect to the rotational shaft 66. Therefore, the rotational shaft 66 is not rotated until the key groove 74 abuts against the key 73. In other words, if the key 73 does not abut against the key groove 74 during the rotation of the rotational shaft 66, the rotational shaft 66 idles with respect to the gear 48B. Therefore, the gear 48B is not rotated until the key 73 abuts against the key groove 74. On the other hand, if the key groove 74 abuts against the key 73 during the rotation of the gear 48B, and the key groove 74 pushes the key 73, then the rotational shaft 66 is rotated integrally with the gear 48B. In other words, if the key 73 abuts against the key groove 74 during the rotation of the rotational shaft 66, and the key 73 pushes the key groove 74, then the gear 48B is rotated integrally with the rotational shaft 66. According to the above, the second driving transmission unit 36 has the so-called play (slack or backlash) between the key 73 and the key groove 74 in the circumferential direction of the gear 48B.

Conversely to the above, it is also allowable that the key groove 74 is provided on the rotational shaft 66 and the key 73 is provided on the gear 48B. Further, it is also allowable that the key 73 and the key groove 74 are provided at positions other than right end of the rotational movement shaft 66 and the gear 48B of the driving transmission mechanism 79, in addition to or in place of the key 73 and the key groove 74 of right end of the rotational movement shaft 66 and the gear 48B. For example, it is also allowable that the key 73 is provided at the left end of the rotational shaft 66 and the key groove 74 is provided on the gear 48C. Alternatively, it is also allowable that the key groove 74 is provided at the left end of the rotational shaft 66 and the key 73 is provided on the gear 48C.

As depicted in FIG. 7, the third driving transmission unit 37 is provided with two gears 77A, 77B, a projection 51 and a rotational shaft 50 of the projection 51. The rotational shaft 50 is provided to extend in the left-right direction 9 from the right of the bypass tray 71 and the lower guide member 97 to the approximately central portion in the left-right direction 9 of the bypass tray 71 and the lower guide member 97.

The gears 77A, 77B constitute a gear train in which they are meshed with each other. The gear 77A, which is arranged at one end of the gear train, is meshed with the intermediate gear 46. The gear 77B, which is arranged at the other end of the gear train, is coupled to the right end of the rotational shaft 50 via a torque limiter 127 as described later on. Accordingly, the gear 77B is rotatable integrally with the rotational shaft 50, and the gear 77B is also rotatable independently from the rotational shaft 50. As depicted in FIGS. 7 and 11, the projection 51 protrudes toward the movable member 64. As described later on, a slide member 116 of the movable member 64 is moved by being pushed by the projection 51. According to the above, the third driving transmission unit 37 transmits the rotary driving force from the intermediate gear 46 to the movable member 64.

The number of the gears of the driving transmission mechanism 79 is not limited to the number depicted in FIGS. 2 and 7. Further, it is also allowable that at least a part of the driving transmission mechanism 79 is constructed by any parts other than the gear. For example, it is also allowable to adopt such a construction that two shafts are spanned by an endless belt to transmit the rotation of one shaft to the other shaft.

<Swingable Member 30>

As depicted in FIG. 6, the swingable member 30 swings in the directions of the arrows 105, 106 so that the feed arm 76 is swung in the directions of the arrows 67, 68. Consequently, the feed rollers 75 are allowed to make contact or separation with respect to the flat surface 45 of the bypass tray 71 or the recording sheet S supported by the flat surface 45. As depicted in FIGS. 7 and 8, the swingable member 30 is provided at one end of the feed arm 76. As depicted in FIG. 9, the swingable member 30 is provided with a swingable element 91, a roller 92 and a clipping member 93.

The swingable element 91 is provided with a pair of side plates 94, a connecting plate 95 which mutually connects parts of the pair of side plates 94 and a protruding part 96 which protrudes from the connecting plate 95. The material of the swingable element 91 is a resin such as POM (polyacetal or polyoxymethylene) or the like.

As depicted in FIG. 8, the right side plate 94 is arranged between the right side plate 111 of the feed arm 76 and the roller gear 49. The left side plate 94 is arranged between the left side plate 111 of the feed arm 76 and the roller gear 49. In this arrangement, the feed rollers 75 are arranged on the right of the right side plate 111 and on the left of the left side plate 111 respectively. In other words, the left side plate 94 in the left-right direction is arranged between the roller gear 49 and the left feed roller 75, and the right side plate 94 in the left-right direction 9 is arranged between the roller gear 94 and the right feed roller 75. Further, the left side plate 111 in the left-right direction 9 is arranged between the left side plate 94 and the left feed roller 75, and the right side plate 111 in the left-right direction 9 is arranged between the right side plate 94 and the right feed roller 75.

As depicted in FIG. 9B, openings 100 are provided at the central portions of the pair of side plates 94 respectively. The rotational shaft 83 of the feed rollers 75 is inserted into the respective openings 100. According to this construction, the swingable element 91, which is composed of the pair of side plates 94, the connecting plate 95 and the protruding part 96, is swingable about the rotational shaft 83 of the feed rollers 75.

As depicted in FIG. 9B, the protruding part 96 protrudes from the connecting plate 95 in the direction away from the outer circumferential surface of the roller gear 49. In other words, the protruding part 96 protrudes from the connecting plate 95 outwardly in the radial direction of the roller gear 49.

Figure 9A:
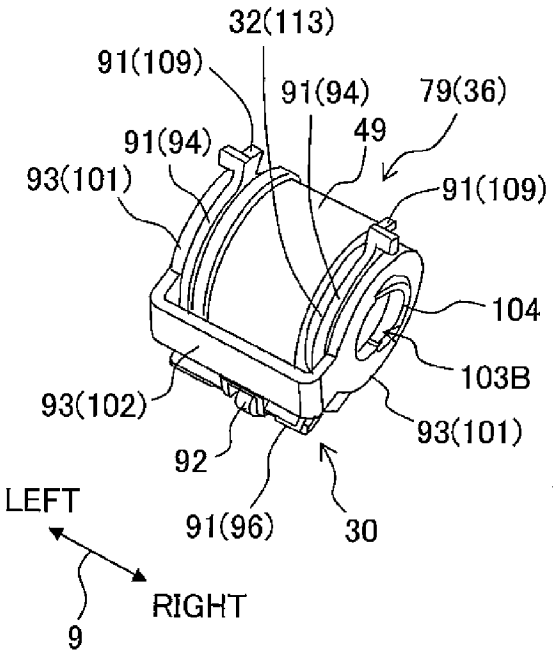
FIG. 9A is a perspective view depicting a swingable member 30 and a roller gear 49.

As depicted in FIG. 9A, the roller 92 is provided at the protruding part 96, i.e., at the forward end of the swing movement of the swingable member 30. The roller 92 is rotatably supported by the protruding part 96 by using the rotational shaft 92A as the center of rotation (see FIG. 9B). The rotational shaft 92A extends in the same direction (left-right direction 9) as the axial direction of the rotational shaft 83 of the feed roller 75. In the state in which the roller 92 is supported by the protruding part 96, a part of the circumferential surface of the roller 92 protrudes outwardly in the radial direction of the roller gear 49 as compared with the protruding part 96.

Figure 10:
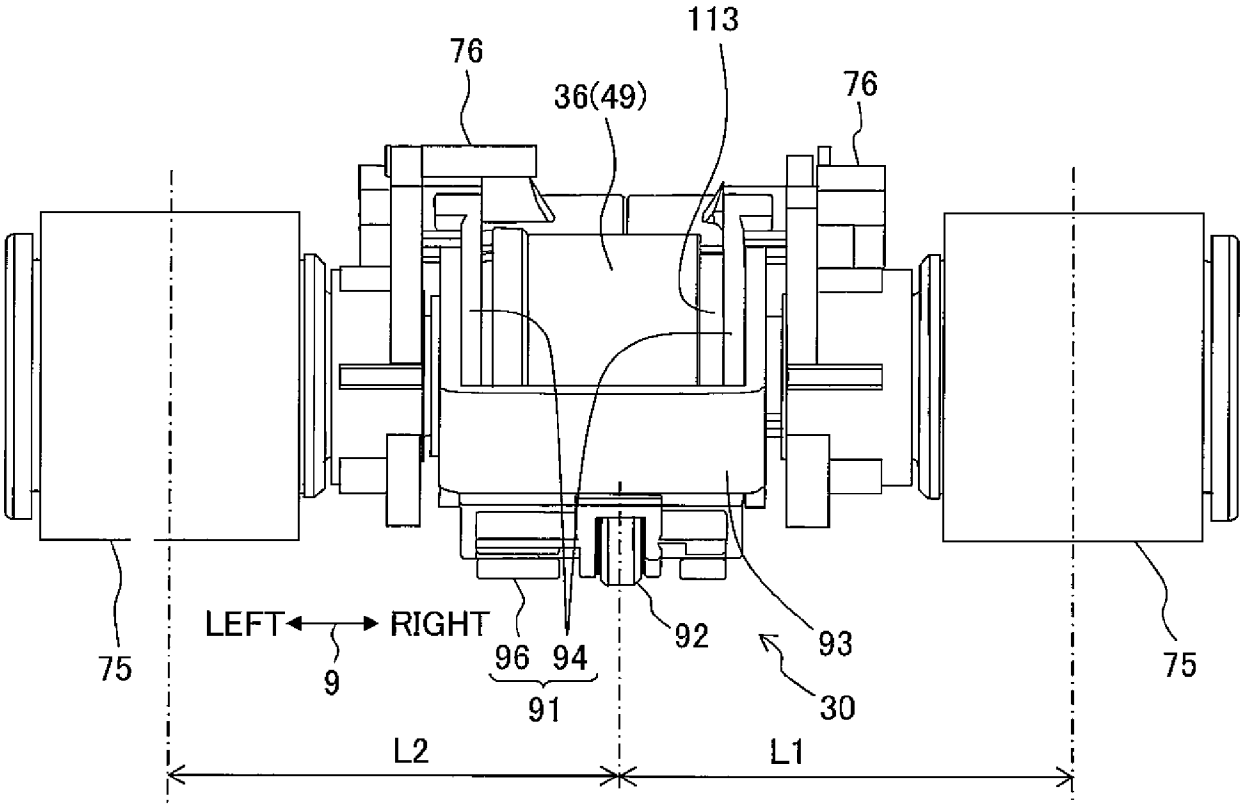
FIG. 10 is a front view depicting those disposed around the feed arm 76.

As depicted in FIG. 10, the roller 92 is arranged at the intermediate position at equal distances from the pair of feed rollers 75 respectively in the left-right direction 9. In other words, the distance L1 in the left-right direction 9 between the roller 92 and the right feed roller 75 is equal to the distance L2 in the left-right direction 9 between the roller 92 and the left feed roller 75.

As depicted in FIG. 9B, the clipping member 93 is provided with a pair of side plates 101 and a connecting plate 102 which connects the pair of side plates 101 to one another. The material of the clipping member 93 is a metal such as SECC (electro galvanized steel sheet) or the like.

As depicted in FIG. 8, the right side plate 101 is arranged between the right side plate 94 of the swingable element 91 and the right side plate 111 of the feed arm 76. Although not depicted in FIG. 8 because of the presence at the hidden position, the left side plate 101 is arranged between the left side plate 94 of the swingable element 91 and the left side plate 111 of the feed arm 76. In other words, the pair of side plates 101 of the clipping member 93 are arranged outside the pair of side plates 94 of the swingable element 91 in the left-right direction 9. That is, the clipping member 93 clips or holds the pair of side plates 94 of the swingable element 91.

As depicted in FIG. 9B, an opening 103A is provided at the central portion of the left side plate 101, and an opening 103B is provided at the central portion of the right side plate 101. The rotational shaft 83 of the feed roller 75 is inserted into the openings 103A, 103B respectively. In this arrangement, the opening 103A of the left side plate 101 has a circular shape. However, a part of the opening 103B of the right side plate 101 has a radius which is larger than a radius of any part other than the concerning part. In other words, the opening 103B has such a shape that a portion of a circular opening is combined with a portion of another circular opening having radius different than that of the circular opening while superposing their center. A rib 104, which is provided for the right side plate 94 of the swingable element 91, is fitted to the opening part of the opening 103B having the large radius (see FIG. 9A). According to this construction, the pair of side plates 101 are swingable integrally with the swingable element 91 about the rotational shaft 83 of the feed rollers 75. Therefore, the swingable element 91 and the clipping member 93 are swung integrally about the rotational shaft 83 of the feed rollers 75. In other words, the swingable member 30 is swung about the rotational shaft 83 of the feed rollers 75.

The swingable element 91 of the swingable member 30 is coupled to a roller gear 49 via a torque limiter 32 as described later on. In this arrangement, as described above, the rotational shaft 83 of the feed rollers 75 is inserted into the roller gear 49, and the roller gear 49 and the feed rollers 75 are integrally rotatable with the rotational shaft 83 as the center of rotation. In other words, the swingable member 30 is coupled to the feed rollers 75 via the torque limiter 32 and the roller gear 49. Further, the rotary driving force of the feeding motor 78 is applied to the swingable member 30 from the roller gear 49 of the second driving transmission unit 36 via the torque limiter 32. Accordingly, the swingable member 30 is swung in the directions of the arrows 105, 106 (see FIG. 6).

As depicted in FIG. 9B, projections 109, which protrude outwardly in the radial direction of the feed roller 75, are provided on the circumferential surfaces of the pair of side plates 94 of the swingable element 91. On the other hand, as depicted in FIG. 13, a first regulating section 107 and a second regulating section 108 are provided on the pair of side plates 111 of the feed arm 76. The first regulating section 107 and the second regulating section 108 regulate the swing movement of the swingable element 91 by making the abutment against the projection 109. In this embodiment, the first regulating section 107 and the second regulating section 108 are ribs each of which protrudes from one toward the other of the pair of side plates 111. The first regulating section 107 and the second regulating section 108 are not limited to the ribs provided that the swing movement of the swingable element 91 can be regulated by making the abutment against the swingable element 91.

Figure 13A:
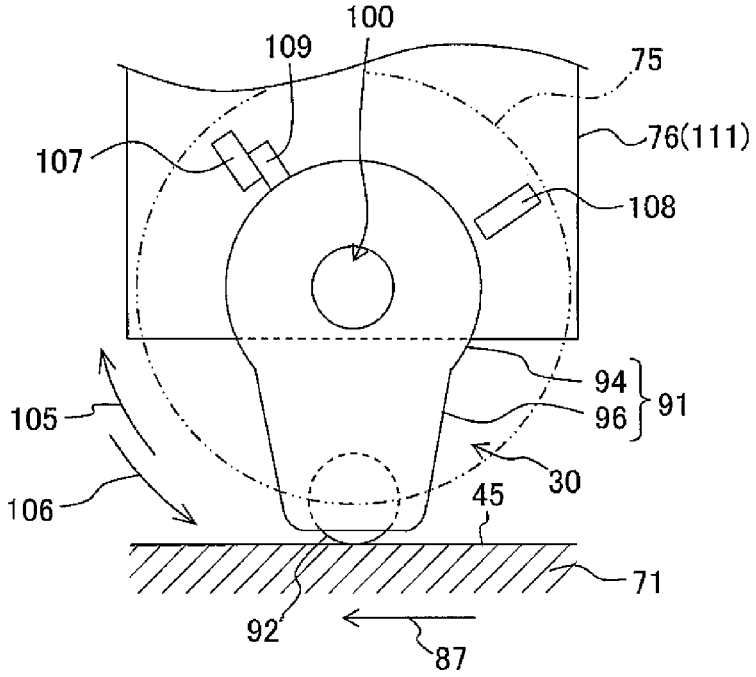

As depicted in FIG. 13A, the projection 109 is allowed to abut against the first regulating section 107 from the upstream side in the direction of the arrow 106. In the state in which the projection 109 abuts against the first regulating section 107, the roller 92 and the protruding part 96 of the swingable member 30 protrude to the side of the flat surface 45 of the bypass tray 71 as compared with the feed rollers 75. The position of the swingable member 30, which is provided in the state depicted in FIG. 13A, is hereinafter referred to as "first position". In other words, the first regulating section 107 regulates the swing movement of the swingable member 30 at the first position.

As described above, the feed arm 76 is urged toward the side of the flat surface 45 of the bypass tray 71 by the torsion spring. Therefore, when the swingable member 30 is disposed at the first position, the roller 92 abuts against the flat surface 45 of the bypass tray 71 or the recording sheet S supported by the flat surface 45. On the other hand, the feed roller 75 is separated from the flat surface 45 of the bypass tray 71 or the recording sheet S supported by the flat surface 45 by being lifted up by the swingable member 30.

Figure 13B:
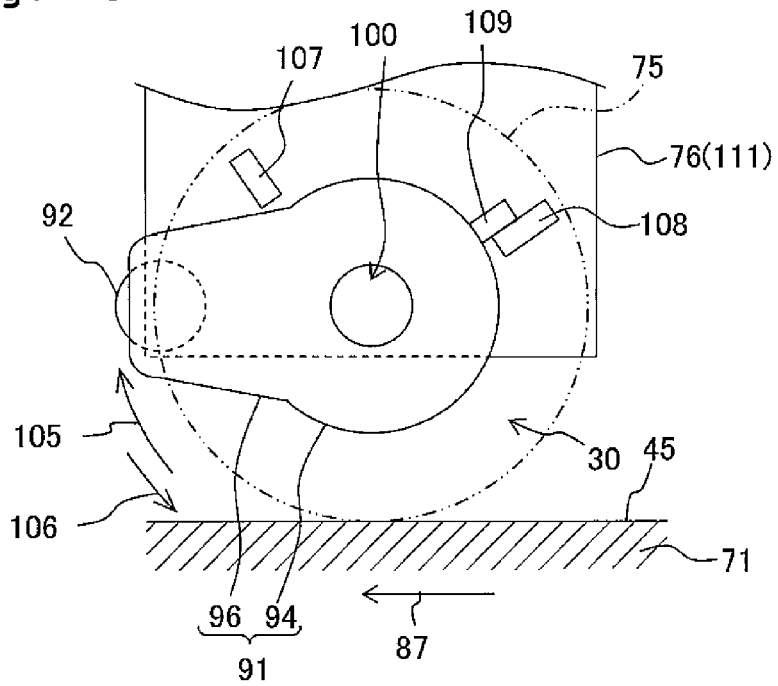

As depicted in FIG. 13B, the projection 109 is allowed to abut against the second regulating section 108 from the upstream side in the direction of the arrow 105. In the state in which the projection 109 abuts against the second regulating section 108, the roller 92 and the protruding part 96 of the swingable member 30 are retracted from the flat surface 45 of the bypass tray 71 as compared with the feed rollers 75. The position of the swingable member 30, which is provided in the state depicted in FIG. 13B, is hereinafter referred to as "second position". In other words, the second regulating section 108 regulates the swing movement of the swingable member 30 at the second position.

When the swingable member 30 is disposed at the second position, the roller 92 is separated from the flat surface 45 of the bypass tray 71. On the other hand, the feed rollers 75 abut against the flat surface 45 of the bypass tray 71 or the recording sheet S supported by the flat surface 45, because the feed arm 76 is urged toward the side of the flat surface 45 of the bypass tray 71 by the torsion spring.

According to the above, as for the swingable member 30, the swing movement thereof is regulated by the first regulating section 107 and the second regulating section 108, and thus the swingable member 30 is swingable within only the range between the first position and the second position.

<Torque Limiter 32>

The torque limiter 32 transmits the rotary driving force from the second driving transmission unit 36 to the swingable member 30. Further, when the swing movement of the swingable member 30 is regulated by the first regulating section 107 or the second regulating section 108, the torque limiter 32 cuts off the transmission of the rotary driving force from the second driving transmission unit 36 to the swingable member 30.

As depicted in FIG. 9B, the torque limiter 32 is provided with a friction member 113 and a compression coil spring 114. Any other elastic member, for example, a plate spring or the like may be used in place of the compression coil spring 114.

The friction member 113 is the member having a columnar shape with a thin thickness. The shape of the friction member 113 is arbitrary. The friction member 113 is arranged between the roller gear 49 and the right side plate 94 of the swingable element 91. In other words, the torque limiter 32, which is provided with the friction member 113, is provided between the swingable member 30 and the second driving transmission unit 36 provided with the roller gear 49. As depicted in FIGS. 9A and 9B, one surface of the friction member 113 abuts against the bottom surface 110 of the roller gear 49. The surface, which is disposed on the back side with respect to the one surface of the friction member 113, abuts against the right side plate 94. The friction member 113 is composed of a material, which has a frictional coefficient higher than those of the roller gear 49 and the side plate 94, for example, felt texture. According to the above, the friction member 113 transmits the rotary driving force from the roller gear 49 to the side plate 94, i.e., from the second driving transmission unit 36 to the swingable member 30.

As depicted in FIG. 9B, an opening 115 is provided at the central portion of the friction member 113. The rotational shaft 83 of the feed rollers 75 is inserted into the opening 115.

It is also allowable that the friction member 113 is arranged between the roller gear 49 and the left side plate 94. Alternatively, it is also allowable that two friction members 113 are provided, one friction member 113 is arranged between the roller gear 49 and the right side plate 94, and the other friction member 113 is arranged between the roller gear 49 and the left side plate 94.

The compression coil spring 114 is arranged in the recess 54 of the roller gear 49. One end of the compression coil spring 114 abuts against the bottom surface 110 of the roller gear 49 (inner side surface in the recess 54). The other end of the compression coil spring 114 abuts against the left side plate 94 of the swingable element 91. The rotational shaft 83 of the feed rollers 75 is inserted into the central portion of the compression coil spring 114.

It is also allowable that the roller gear 49 is arranged while right and left are reversed. In this arrangement, the bottom surface 110 is positioned on the left side of the roller gear 49. Therefore, one end of the compression coil spring 114 abuts against the right side plate 94 of the swingable element 91, and the other end of the compression coil spring 114 abuts against the bottom surface 110 (inner side surface in the recess 54). According to the above, the compression coil spring 114 is arranged between one side plate 94 and the roller gear 49.

The compression coil spring 114, which is arranged in the recess 54 of the roller gear 49, exerts the force in the right direction and the left direction in the left-right direction 9 so that the compression coil spring 114 is the free length. Then, the bottom surface 110 of the roller gear 49 tightly abuts against the friction member 113 by the force exerted in the right direction. In other words, the compression coil spring 114 urges the roller gear 49 toward the friction member 113.

Figure 12A:
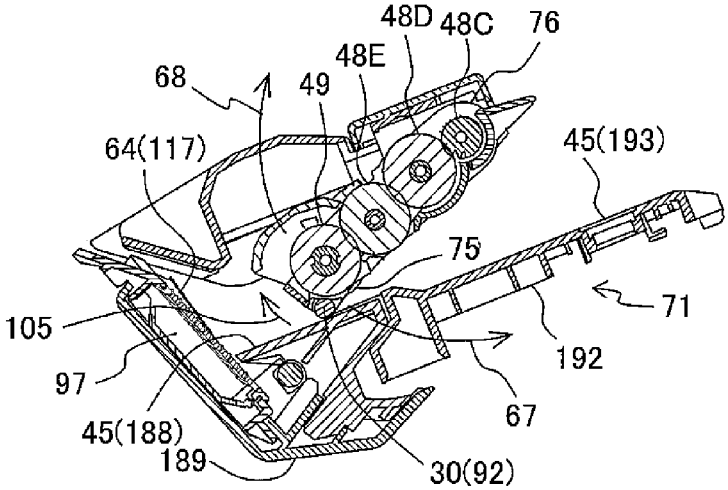

In the state depicted in FIGS. 12A and 13A, when the feed rollers 75 are rotated in the direction of the arrow 125 (see FIG. 6) by being applied the rotary driving force of the forward rotation from the feeding motor 78 via the first driving transmission unit 35 and the second driving transmission unit 36, the rotary driving force is transmitted to the swingable member 30 via the torque limiter 32. Accordingly, the swingable member 30 is swung in the direction of the arrow 105 from the first position (position of the swingable member 30 in the state depicted in FIGS. 12A and 13A) toward the second position (position of the swingable member 30 in the state depicted in FIGS. 12C and 13B). In other words, the swingable member 30 is swung integrally with the rotating feed rollers 75.

When the projection 109 of the swingable member 30 abuts against the second regulating section 108, i.e., when the swingable member 30 arrives at the second position (see FIGS. 12C and 13B), the swing movement of the swingable member 30 is stopped. Accordingly, only the feed rollers 75 out of the feed rollers 75 and the swingable member 30 continue the rotation in the direction of the arrow 125 against the frictional force exerted by the friction member 113. In other words, the transmission of the rotary driving force to the swingable member 30 is cut off by the torque limiter 32.

Figure 12B:
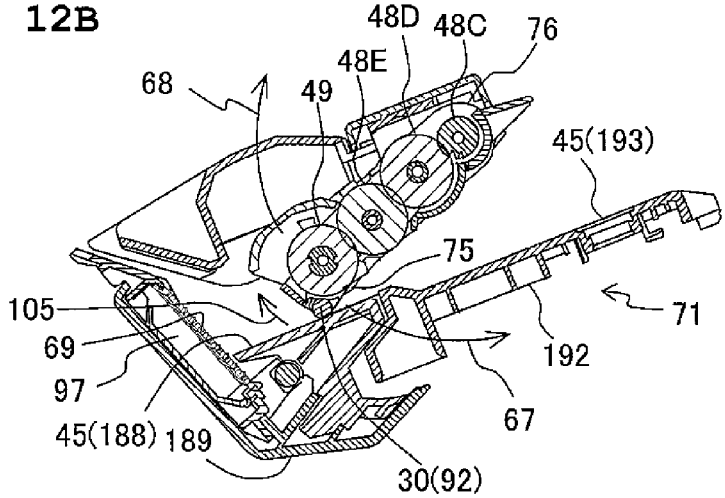
Figure 12C:
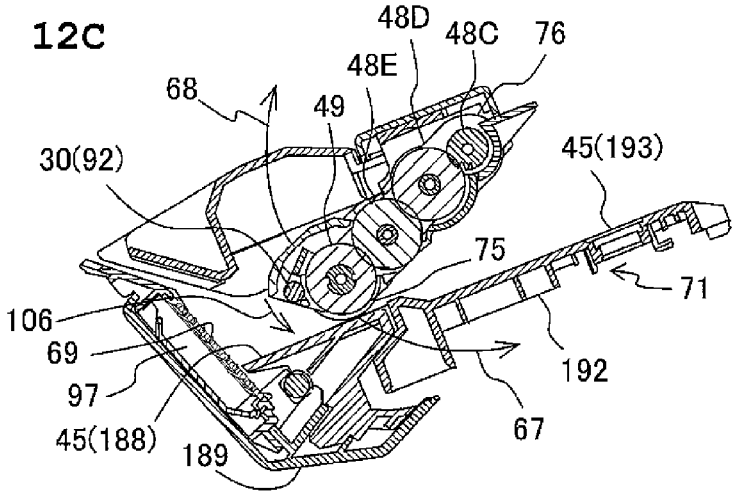

On the other hand, when the feed rollers 75 are rotated in the direction of the arrow 126 (see FIG. 6) by being applied the rotary driving force of the reverse rotation from the feeding motor 78 via the first driving transmission unit 35 and the second driving transmission unit 36 as depicted in FIGS. 12C and 13B, the rotary driving force is transmitted to the swingable member 30 via the friction member 113 of the torque limiter 32. Accordingly, the swingable member 30 is swung in the direction of the arrow 106 from the second position toward the first position. In other words, the swingable member 30 is swung integrally with the rotating feed rollers 75.

When the projection 109 of the swingable member 30 abuts against the first regulating section 107, i.e., when the swingable member 30 arrives at the first position (see FIGS. 12A and 13A), the swing movement of the swingable member 30 is stopped. Accordingly, only the feed rollers 75 out of the feed rollers 75 and the swingable member 30 continue the rotation in the direction of the arrow 126 against the frictional force exerted by the friction member 113. In other words, the transmission of the rotary driving force to the swingable member 30 is cut off by the torque limiter 32.

<Movable Member 64>

As depicted in FIG. 7, the movable member 64 is arranged in the recess 86 provided on the upper surface 69 of the lower guide member 97. In other words, the movable member 64 is provided for the lower guide member 97.

As depicted in FIG. 11, the movable member 64 is provided with the slide member 116 and an abutment member 117. The slide member 116 is supported by the bottom surface 84 of the recess 86. The abutment member 117 is supported by the slide member 116, and the abutment member 117 can abut against the forward end of the recording sheet S supported by the bypass tray 71.

The slide member 116 is movable in the front-rear direction 8 along the bottom surface 84 of the recess 86. A first recess 118 and a second recess 119 are provided on the surface 120 of the slide member 116, i.e., on the surface 120 disposed on the side opposite to the surface of the slide member 116 brought in contact with the bottom surface 84 of the recess 86. The projection 51 of the third driving transmission unit 37 is inserted into the first recess 118. A projection 58 of the abutment member 117 can be inserted into the second recess 119 as described later on.

The abutment member 117 abuts against the surface 120 of the slide member 116. The abutment member 117 is provided with the projection 58 which protrudes toward the slide member 116. The abutment member 117 is movable based on the movement of the slide member 116 to the protruding position protruding from the upper surface 69 of the lower guide member 97 (position of the abutment member 117 in the state depicted in FIG. 11B) and the retracted position retracted from the upper surface 69 (position of the abutment member 117 in the state depicted in FIG. 11A).

Figure 11B:
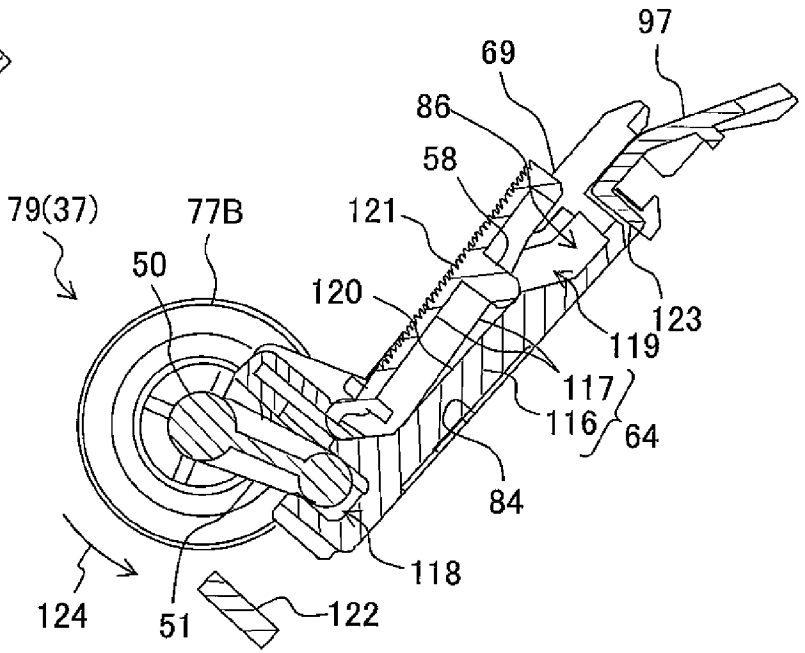
Figure 11A:
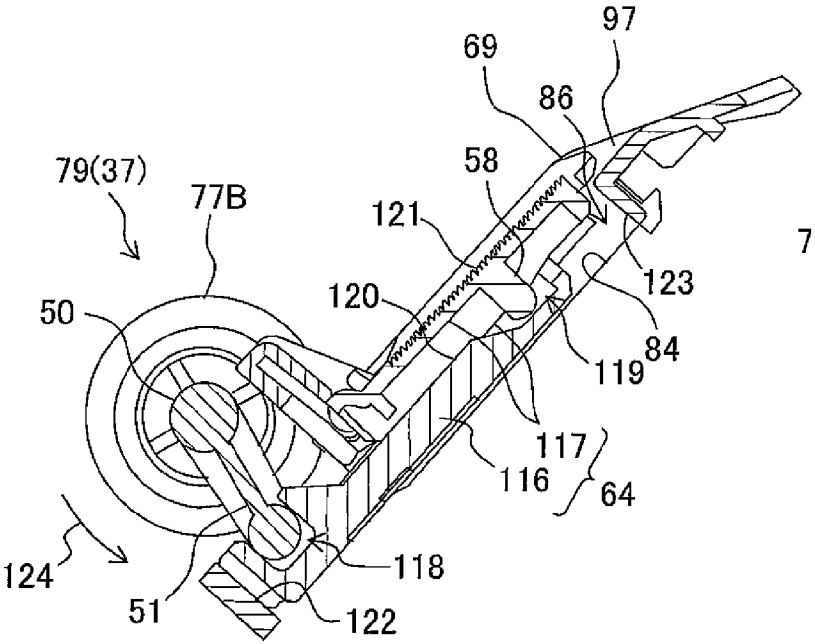

A detailed explanation will be described below. As depicted in FIG. 11A, the projection 58 of the abutment member 117 is inserted into the second recess 119 of the slide member 116 in the state in which the slide member 116 abuts against the first side surface 122 of the recess 86 of the lower guide member 97. In this state, the abutment member 117 is retracted from the upper surface 69 into the recess 86, and the abutment member 117 is disposed at the retracted position.

In this state, when the gear 77B of the third driving transmission unit 37 is rotated in the direction of the arrow 124, then the slide member 116 is pushed by the projection 51 swung integrally with the rotating gear 77B, and the slide member 116 is moved toward the second side surface 123 of the recess 86. Accordingly, the projection 58, which has been inserted into the second recess 119, is allowed to escape from the second recess 119, and the projection 58 is supported by the surface 120 as depicted in FIG. 11B. That is, the surface 120 of the slide member 116 constitutes a cam surface. As a result, the surface 121 of the abutment member 117 protrudes from the upper surface 69 of the lower guide member 97. In other words, the abutment member 117 is disposed at the protruding position.

The slide member 116 can be moved until the slide member 116 abuts against the second side surface 123. In other words, the second side surface 123 abuts against the slide member 116 of the movable member 64 to regulate the movement of the slide member 116, and thus the movement of the abutment member 117 of the movable member 64 is regulated at the protruding position.

When the gear 77B is rotated in the direction opposite to the direction of the arrow 124 in the state in which the slide member 116 abuts against the second side surface 123 and the abutment member 117 is disposed at the protruding position as depicted in FIG. 11B, then the slide member 116 is pushed by the projection 51, and the slide member 116 is moved toward the first side surface 122 of the recess 86. Accordingly, the projection 58 is moved while making abutment against the surface 120, and the projection 58 is inserted into the second recess 119 as depicted in FIG. 11A. As a result, the surface 121 of the abutment member 117 is retracted from the upper surface 69 of the lower guide member 97 into the recess 86. In other words, the abutment member 117 is disposed at the retracted position.

The slide member 116 can be moved until the slide member 116 abuts against the first side surface 122. In other words, the first side surface 122 abuts against the slide member 116 of the movable member 64 to regulate the movement of the slide member 116, and thus the movement of the abutment member 117 of the movable member 64 is regulated at the retracted position.

The torque limiter 127 (see FIGS. 5 and 7) is provided between the rotational shaft 50 and the gear 77B of the third driving transmission unit 37. The torque limiter 127 switches the presence or absence of the transmission of the rotary driving force in the third driving transmission unit 37.

Figure 5:
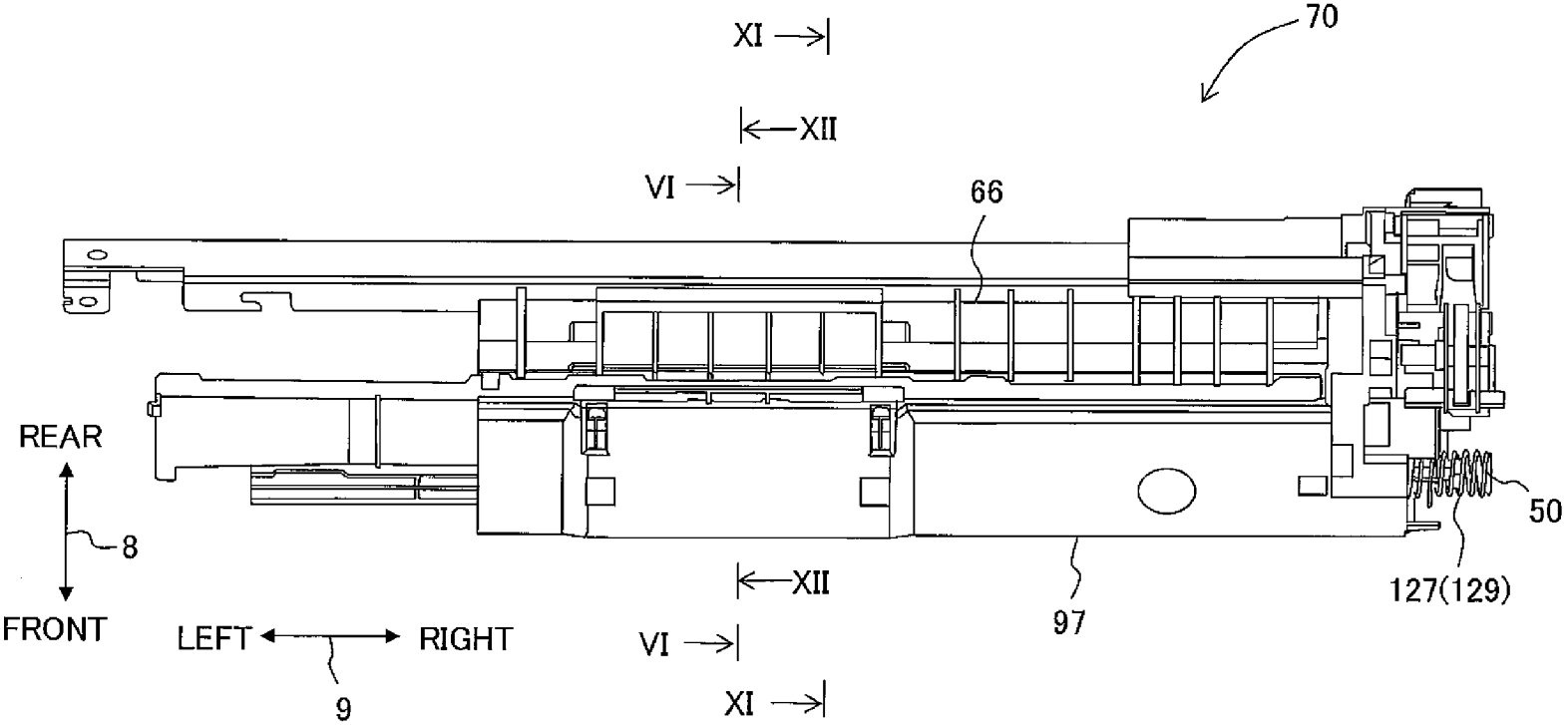
FIG. 5 is a front view depicting a feed apparatus 70.

The torque limiter 127 is provided with a flange section 128 (see FIG. 7), a friction member (not depicted) and a compression coil spring 129 (see FIG. 5). The flange section 128 protrudes from the circumferential surface of the rotational shaft 50. The friction member (not depicted) is arranged between the flange section 128 and the gear 77B. The compression coil spring 129 is arranged on the side opposite to the friction member with respect to the gear 77B, and the compression coil spring 129 urges the gear 77B toward the friction member. The gear 77B is pressed against the flange section 128 via the friction member by being urged by the compression coil spring 129. The construction of the torque limiter 127 is not limited to the construction described above. It is possible to adopt any arbitrary construction of the torque limiter.

When the slide member 116 is in a movable state in the operation of the movable member 64 described above, the torque limiter 127 transmits the rotary driving force from the gear 77B via the friction member to the flange section 128. In other words, the gear 77B and the rotational shaft 50 provided with the flange section 128 are rotated integrally by the aid of the torque limiter 127.

On the other hand, in the operation of the movable member 64 described above, when the slide member 116, which is moved toward the first side surface 122, abuts against the first side surface 122, or when the slide member 116, which is moved toward the second side surface 123, abuts against the second side surface 123, then the torque limiter 127 cuts off the transmission of the rotary driving force from the gear 77B to the rotational shaft 50. In other words, the rotation of the rotational shaft 50 is regulated by the abutment of the slide member 116 against the first side surface 122 or the second side surface 123. Therefore, the rotation of the rotational shaft 50 is stopped, and the gear 77B idles with respect to the rotational shaft 50. That is, the gear 77B is rotated independently from the rotational shaft 50. According to the above, when the movement of the movable member 64 is regulated by the first side surface 122 or the second side surface 123, the torque limiter 127 cuts off the transmission of the rotary driving force in the third driving transmission unit 37.

The position, at which the torque limiter 127 is provided, is not limited to the position between the gear 77B and the rotational shaft 50. For example, it is also allowable that the torque limiter 127 is provided between the gear 77B and the rotational shaft of the gear 77B.

When the abutment member 117 is disposed at the protruding position, the recording sheet S, which is fed in the feed direction 87, can abut against the surface 121 (example of the restraining surface of the present teaching) of the abutment member 117 (see FIG. 11). As depicted in FIG. 11, the surface 121 has grooves extending in the left-right direction 9 (direction perpendicular to the paper surface of FIG. 11), the grooves being formed at constant intervals. Thus, the surface 121 has a saw blade shape as viewed in a side view from the right or the left. Accordingly, the forward end of the recording sheet S allowed to abut against the surface 121, i.e., the downstream end, in the feed direction 87, of the recording sheet S is fitted into the groove. As a result, the movement of the recording sheet S is restrained by the surface 121. It is not indispensable that the surface 121 has the saw blade shape on condition that the recording sheet S abutting against the surface 121 can be restrained. For example, it is also allowable that the surface 121 is stuck with a cork having a high frictional coefficient, and thus the surface 121 restrains the movement of the recording sheet S abutting against the surface 121.

<Operation of Feed Apparatus 70>

An explanation will be made below about the operation of the feed apparatus 70 when the feeding motor 78 is rotated forwardly and reversely. It is assumed that the initial state is the state depicted in FIG. 12A. However, the recording sheet S is not depicted in FIGS. 12A to 12C in order to make understanding of the operation of the respective components of the feed apparatus 70 easier. In the following explanation, it is assumed that a plurality of recording sheets S are supported by the flat surface 45 of the bypass tray 71.

At first, an explanation will be made about the operation of the feed apparatus 70 when the feeding motor 78 is rotated forwardly in the initial state depicted in FIG. 12A. In the state depicted in FIG. 12A, the swingable member 30 is disposed at the first position. In this situation, as described above, the roller 92 abuts against the recording sheet S supported by the flat surface 45 of the bypass tray 71. On the other hand, the feed rollers 75 are disposed at the separated positions separated from the recording sheet S by being lifted up by the swingable member 30. Further, in the state depicted in FIG. 12A, the abutment member 117 of the movable member 64 is disposed at the protruding position, and the slide member 116 of the movable member 64 abuts against the second side surface 123 (see FIG. 11B).

When the feeding motor 78 is rotated forwardly in this state, the rotary driving force of the forward rotation of the feeding motor 78 is transmitted to the feed rollers 75 via the first driving transmission unit 35, the intermediate gear 46 and the second driving transmission unit 36. Further, the rotary driving force of the forward rotation of the feeding motor 78 is also transmitted to the swingable member 30 via the first driving transmission unit 35, the intermediate gear 46, the second driving transmission unit 36 and the torque limiter 32. Furthermore, the rotary driving force of the forward rotation of the feeding motor 78 is also transmitted to the movable member 64 via the first driving transmission unit 35, the intermediate gear 46 and the third driving transmission unit 37.

When the rotary driving force of the forward rotation of the feeding motor 78 is transmitted, then the feed rollers 75 are thereby rotated in the direction of the arrow 125 (in the direction to feed the recording sheet S in the feed direction 87, see FIG. 6), and the swingable member 30 is thereby swung in the direction of the arrow 105 (in the direction directed from the first position to the second position).

When the swingable member 30 is swung from the first position toward the second position, the roller 92 is separated from the recording sheet S. Accordingly, the feed arm 76 is urged by the torsion spring, and the feed arm 76 is swung in the direction of the arrow 67. As a result, the feed rollers 75, which have been lifted up by the swingable member 30, are moved from the separated position (position of the feed roller 75 in the state depicted in FIG. 12A) toward the abutment position to make the abutment against the recording sheet S supported by the bypass tray 71 (position of the feed roller 75 in the state depicted in FIG. 12C). According to the above, when the rotary driving force of the forward rotation is applied from the feeding motor 78, the swingable member 30 moves the feed rollers 75 from the separated position to the abutment position. As described above, the separated position is positioned on the side opposite to the flat surface 45 in relation to the abutment position in the direction orthogonal to the flat surface 45. In other words, the abutment position is defined between the separated position and the flat surface 45 in the direction orthogonal to the flat surface 45.

In the state depicted in FIG. 12A, the feed rollers 75 are separated from the recording sheet S. In other words, the feed rollers 75 do not abut against the recording sheet S. Therefore, even when the feed rollers 75 are rotated in the direction of the arrow 125 (see FIG. 6) in the state depicted in FIG. 12A, the feed rollers 75 do not feed the recording sheet S in the feed direction 87. The feed rollers 75 start the feeding of the recording sheet S in the feed direction 87 when the roller 92 is separated from the recording sheet S in accordance with the swing movement of the swingable member 30 toward the second position, and thus the feed rollers 75, which are rotated in the direction of the arrow 125, arrive at the abutment position.

Further, the rotary driving force of the forward rotation of the feeding motor 78 is transmitted to the rotational shaft 50 of the third driving transmission unit 37, and thus the rotational shaft 50 of the third driving transmission unit 37 is rotated in the direction opposite to the direction of the arrow 124 as depicted in FIG. 11B. Accordingly, the slide member 116 of the movable member 64 is pushed by the projection 51, and thus the slide member 116 of the movable member 64 is moved from the second side surface 123 toward the first side surface 122. As a result, the abutment member 117 of the movable member 64 is moved from the protruding position toward the retracted position.

In this arrangement, as described above, as for the second driving transmission unit 36, the play in the circumferential direction is given to the coupling of the gear 48B and the rotational shaft 66 owing to the construction including the key 73 and the key groove 74. Accordingly, the delay arises in the transmission of the rotary driving force from the gear 48B to the rotational shaft 66. As a result, after the start of the forward rotation of the feeding motor 78, the timings, at which the rotation of the feed rollers 75 is started and the swing movement of the swingable member 30 is started come after the timing at which the movement of the movable member 64 is started. Further, the time, which elapses from the start of the swing movement of the swingable member 30 to the abutment of the feed rollers 75 against the recording sheet S, is different from the time which elapses from the start of the movement of the abutment member 117 of the movable member 64 from the protruding position toward the retracted position to the arrival at the retracted position.

The lengths of the key 73 and the key groove 74 in the circumferential direction of the gear 48B are determined to fulfill the following condition on the basis of the difference in the timing and the difference in the time as described above.

The condition resides in that the abutment member 117 is moved from the protruding position to the retracted position before the feed rollers 75 are moved from the separated position to the abutment position. More specific explanation is as follows. The forward rotation of the feeding motor 78 is started to transmit the driving force to the swingable member 30 via the first driving transmission unit 35, the intermediate gear 46 and the second driving transmission unit 36 in the state in which the abutment member 117 of the movable member 64 is disposed at the protruding position and the feed rollers 75 are disposed at the separated position (see FIG. 12A), and thus the swingable member 30 moves the feed rollers 75 from the separated position to the abutment position. It is assumed that the time, which is required for this process, is T1. On the other hand, the forward rotation of the feeding motor 78 is started to transmit the driving force to the movable member 64 via the first driving transmission unit 35, the intermediate gear 46 and the third driving transmission unit 37, and thus the abutment member 117 of the movable member 64 is moved from the protruding position to the retracted position. It is assumed that the time, which is required for this process, is T2. In this case, T1 is set to be longer than T2 (T1>T2).

According to the above, the timing, at which the feed rollers 75 abut against the recording sheet S, comes after the timing at which the abutment member 117 of the movable member 64 arrives at the retracted position. In other words, when the feeding motor 78 starts the forward rotation in the state depicted in FIG. 12A, the movable member 64, which starts the movement from the protruding position, firstly arrives at the retracted position (see FIG. 12B). In this situation, the feed rollers 75 do not abut against the recording sheet S yet. In other words, the feed rollers 75 do not arrive at the abutment position yet. Subsequently, the feed rollers 75 abut against the recording sheet S (see FIG. 12C). In other words, the feed rollers 75, which start the movement from the separated position in accordance with the swing movement of the swingable member 30, arrive at the abutment position.

The recording sheet S, against which the feed rollers 75 abut, is fed in the feed direction 87 in accordance with the rotation of the feed rollers 75 in the direction of the arrow 125 (see FIG. 6). The swingable member 30 arrives at the second position simultaneously with the arrival of the feed rollers 75 at the abutment position or after the arrival of the feed rollers 75 at the abutment position. Further, the slide member 116 of the movable member 64 abuts against the first side surface 122 simultaneously with the arrival of the abutment member 117 of the movable member 64 at the retracted position or after the arrival of the abutment member 117 of the movable member 64 at the retracted position (see FIG. 11A).

Next, an explanation will be made about the operation of the feed apparatus 70 when the feeding motor 78 is reversely rotated in the state depicted in FIG. 12C. In the state depicted in FIG. 12C, the swingable member 30 is disposed at the second position. In this situation, as described above, the roller 92 is separated from the recording sheet S supported by the flat surface 45 of the bypass tray 71. On the other hand, the feed rollers 75 abut against the recording sheet S supported by the flat surface 45 of the bypass tray 71. In other words, the feed rollers 75 are disposed at the abutment position. Further, in the state depicted in FIG. 12C, the abutment member 117 of the movable member 64 is disposed at the retracted position, and the slide member 116 of the movable member 64 abuts against the first side surface 122 (see FIG. 11A).

When the feeding motor 78 is reversely rotated in this state, the rotary driving force of the reverse rotation of the feeding motor 78 is transmitted to the feed rollers 75 via the first driving transmission unit 35, the intermediate gear 46 and the second driving transmission unit 36. Further, the rotary driving force of the reverse rotation of the feeding motor 78 is also transmitted to the swingable member 30 via the first driving transmission unit 35, the intermediate gear 46, the second driving transmission unit 36 and the torque limiter 32. Furthermore, the rotary driving force of the reverse rotation of the feeding motor 78 is also transmitted to the movable member 64 via the first driving transmission unit 35, the intermediate gear 46 and the third driving transmission unit 37.

When the rotary driving force of the reverse rotation of the feeding motor 78 is transmitted, then the feed rollers 75 are thereby rotated in the direction of the arrow 126 (direction in which the recording sheet S is fed in the direction opposite to the feed direction 87, see FIG. 6), and the swingable member 30 is swung in the direction of the arrow 106 (direction from the second position to the first position).

When the swingable member 30 is swung from the second position toward the first position, the roller 92 firstly abuts against the recording sheet S. When the swingable member 30 is further swung from the second position toward the first position, then the roller 92 lifts up the feed rollers 75, and hence the feed arm 76 is swung in the direction of the arrow 68 against the urging action brought about by the torsion spring. As a result, the feed rollers 75 are moved from the abutment position to the separated position. According to the above, when the rotary driving force of the reverse rotation is applied from the feeding motor 78, the swingable member 30 moves the feed rollers 75 from the abutment position to the separated position.

When the rotary driving force of the reverse rotation of the feeding motor 78 is transmitted, the rotational shaft 50 of the third driving transmission unit 37 is thereby rotated in the direction of the arrow 124 as depicted in FIG. 11A. Accordingly, the slide member 116 of the movable member 64 is pushed by the projection 51, and thus the slide member 116 of the movable member 64 is moved from the first side surface 122 toward the second side surface 123. As a result, the abutment member 117 of the movable member 64 is moved from the retracted position toward the protruding position.

In this arrangement, as described above, as for the second driving transmission unit 36, the play in the circumferential direction is given to the coupling of the gear 48B and the rotational shaft 66 owing to the construction including the key 73 and the key groove 74. Accordingly, the delay arises in the transmission of the rotary driving force from the gear 48B to the rotational shaft 66 in the same manner as in the case in which the feeding motor 78 is rotated forwardly. As a result, after the start of the reverse rotation of the feeding motor 78, the timings, at which the rotation of the feed rollers 75 is started and the swing movement of the swingable member 30 is started come after the timing at which the movement of the movable member 64 is started. Further, the time, which elapses from the start of the swing movement of the swingable member 30 to the separation of the feed rollers 75 from the recording sheet S, is different from the time which elapses from the start of the movement of the abutment member 117 of the movable member 64 from the retracted position toward the protruding position to the arrival at the protruding position.

Therefore, the timing, at which the feed rollers 75 are separated from the recording sheet S, comes after the timing at which the abutment member 117 of the movable member 64 arrives at the protruding position. In other words, when the feeding motor 78 starts the reverse rotation in the state depicted in FIG. 12C, then the movable member 64, which starts the movement from the retracted position, firstly arrives at the protruding position, and the feed rollers 75, which start the movement from the abutment position, subsequently arrive at the separated position.

The swingable member 30 arrives at the first position simultaneously with the arrival of the feed rollers 75 at the separated position or after the arrival of the feed rollers 75 at the separated position. Further, the slide member 116 of the movable member 64 abuts against the second side surface 123 simultaneously with the arrival of the abutment member 117 of the movable member 64 at the projection position or after the arrival of the abutment member 117 of the movable member 64 at the protruding position (see FIG. 11B).

Effect of Embodiment

According to the embodiment of the present teaching, the time, which elapses until the feed rollers 75 arrive at the abutment position after the start of the forward rotation of the feeding motor 78 in the state in which the movable member 64 is disposed at the protruding position and the feed rollers 75 are disposed at the separated position, is longer than the time which elapses until the movable member 64 arrives at the retracted position after the start of the forward rotation of the feeding motor 78 in the state in which the movable member 64 is disposed at the protruding position and the feed rollers 75 are disposed at the separated position. Therefore, the feed rollers 75 abut against the recording sheet S supported by the bypass tray 71 after the movable member 64 is moved to the retracted position. Accordingly, when the recording sheet S supported by the bypass tray 71 is fed in the feed direction 87 by the feed rollers 75, it is possible to prevent the recording sheet S from being brought in contact with the movable member 64.

Further, according to the embodiment of the present teaching, the application of the rotary driving force to the swingable member 30 is delayed by the time corresponding to the play existing between the rotational shaft 66 and the gear 48B of the second driving transmission unit 36. Accordingly, it is possible to delay the timing for the feed rollers 75 to start the movement from the separated position to the abutment position. As a result, it is possible to prolong the time until the feed rollers 75 arrive at the abutment position after the start of the forward rotation of the feeding motor 73 in the state in which the movable member 64 is disposed at the protruding position and the feed rollers 75 are disposed at the separated position.

Further, according to the embodiment of the present teaching, it is possible to delay the timing for the feed rollers 75 to start the movement from the separated position to the abutment position. Therefore, the separated position and the abutment position of the feed rollers 75 can be near to one another without shortening the time until the feed rollers 75 arrive at the abutment position after the start of the forward rotation of the feeding motor 78 in the state in which the movable member 64 is disposed at the protruding position and the feed rollers 75 are disposed at the separated position. As a result, it is possible to shorten the distance of movement of the feed rollers 75 brought about by the swingable member 30.

Further, according to the embodiment of the present teaching, the feed rollers 75 and the feed arm 76 can be lifted up to move the feed rollers 75 to the separated position by swinging the swingable member 30 to the first position. Further, according to the embodiment of the present teaching, the feed rollers 75 can be moved to the abutment position by swinging the swingable member 30 to the second position.

Further, according to the embodiment of the present teaching, the torque limiter 127, which is provided for the third driving transmission unit 37, is coupled to the swingable member 30 via the intermediate gear 46 and the second driving transmission unit 36. Accordingly, it is possible to avoid the rotation of the gear of the second driving transmission unit 36 which would be otherwise caused when the feeding motor 78 is stopped in the state in which the feed rollers 75 are disposed at the separated position (state in which the feed rollers 75 are not connected to the feeding motor 78). As a result, it is possible to avoid such a situation that the feed rollers 75 disposed at the separated position are erroneously moved to the abutment position.

First Modified Embodiment

In the embodiment described above, the key 73 is provided for the rotational shaft 66, the key groove 74 is provided for the gear 48B, and thus the play in the circumferential direction of the gear 48B is formed between the rotational shaft 66 and the gear 48B. However, it is also allowable that the play as described above is formed between the feed rollers 75 and the roller gear 49.

An explanation will be made in detail below about an exemplary construction in which the play is formed between the feed rollers 75 and the roller gear 49. In the embodiment described above, the roller gear 49 is attached to the rotational shaft 83 of the feed roller 75, and the roller gear 49 is rotatable integrally with the rotational shaft 83. However, in this embodiment, the roller gear 49 is coupled to the rotational shaft 83 by the key and the key groove provided for the rotational shaft 66 and the gear 48B of the embodiment described above. In other words, a key having a construction same as that of the key provided for the rotational shaft 66, is provided for the rotational shaft 83 of the feed rollers 75, and a key groove to which the key is fitted or inserted, i.e., the key groove having a construction same as that of the key groove provided for the gear 48B, is provided at a position of the roller gear 49 corresponding to the key.

Accordingly, the roller gear 49 idles with respect to the rotational shaft 83 of the feed rollers 75 in a state in which the key groove 74 does not abut against the key 73 and the key groove 74 does not push the key 73 during the rotation of the roller gear 49. Therefore, the rotational shaft 83 of the feed rollers 75 is not rotated. On the other hand, the rotational shaft 83 of the feed roller 75 is rotated integrally with the roller gear 49 in a state in which the key groove 74 abuts against the key 73 and the key groove 74 pushes the key 73 during the rotation of the gear 48B. According to the above, the rotational shaft 83 of the feed rollers 75 and the roller gear 49 are fitted to one another by means of the key and the key groove having the play in the circumferential direction.

According to the first modified embodiment, the play is provided between the rotational shaft 83 of the feed rollers 75 and the roller gear 49. Therefore, the start of the rotation of the feed rollers 75 is delayed by the time corresponding to the play from the start of the rotation of the roller gear 49. On the other hand, the swingable member 30 starts the swing movement simultaneously with the start of the rotation of the roller gear 49. Accordingly, the start of the rotation of the feed rollers 75 can be delayed from the start of the swing movement of the swingable member 30. As a result, it is possible to delay the timing for the feed rollers 75 to start the feeding of the recording sheet S. Therefore, when the recording sheet S, which is supported by the bypass tray 71, is fed in the feed direction 87 by the feed rollers 75, it is possible to lower the possibility for the recording sheet S to be brought in contact with the movable member 64. Further, the rotation of the feed rollers 75 can be started after the movement of the feed rollers 75 to the separated position. Therefore, it is possible to avoid the feeding of the recording sheet S in the opposite direction, which would be otherwise caused by the reverse rotation of the feed rollers 75.

Second Modified Embodiment

In the embodiment described above, the two feed rollers 75 are provided. However, it is also allowable that the number of the feed roller or feed rollers 75 is any number other than two. For example, it is also allowable that only one feed roller 75 is provided.

Third Modified Embodiment

In the embodiment described above, the roller gear 49 is arranged between the pair of feed rollers 75. However, it is also allowable that the roller gear 49 is arranged at any position other than the position between the pair of feed rollers 75. For example, it is also allowable that the roller gear 49 is arranged on the right of the feed roller 75.

Fourth Modified Embodiment

In the embodiment described above, the swingable member 30 is provided with the roller 92. However, it is also allowable that the swingable member 30 is not provided with the roller 92. In this case, when the swingable member 30 is disposed at the first position, the protruding part 96 abuts against the flat surface 45 of the bypass tray 71 or the recording sheet S supported by the flat surface 45.

Fifth Modified Embodiment

In the embodiment described above, the swingable member 30 is swung by applying the rotary driving force from the roller gear 49. However, it is also allowable that the swingable member 30 is swung by applying the rotary driving force from any gear other than the roller gear 49 of the driving transmission mechanism 79. For example, it is also allowable that the swingable member 30 is swung by applying the rotary driving force from the gear 48E. In this case, one surface of the friction member 113 abuts against the gear 48E, and another surface of the friction member 113 disposed on the back of the one surface abuts against the right side plate 94. According to the above, it is appropriate that the torque limiter 32 is provided between the swingable member 30 and any one of the gears for constructing the gear train of the driving transmission mechanism 79.

Sixth Modified Embodiment

In the embodiment described above, the feed apparatus 70 is the apparatus for feeding the recording sheet S supported by the flat surface 45 of the bypass tray 71. However, the feed apparatus 70 can be an apparatus for feeding the recording sheet S supported by any tray other than the flat surface 45 of the bypass tray 71. For example, the feed apparatus 70 can be an apparatus for feeding the recording sheet S supported by the feed tray 20.

In this case, the feed apparatus 70 is provided with the feed tray 20, the feed roller 25, the feed arm 26 and the separation member 197, in place of the bypass tray 71, the feed roller 75, the feed arm 76 and the lower guide member 97. Further, the swingable member 30 is provided at a forward end portion of the feed arm 26. The first regulating section 107 and the second regulating section 108 are provided for the feed arm 26. The movable members 64 are arranged in recesses (not depicted) provided on the right side and the left side of the separation member 197.

Seventh Modified Embodiment

In the embodiment described above, the feed apparatus 70 is provided for the printer unit 11. However, the apparatus or unit, which is provided with the feed apparatus 70, is not limited to the printer unit 11. For example, it is also allowable that the feed apparatus 70 is provided for the scanner unit 12. In this case, the feed apparatus 70 feeds, into the scanner unit 12, the sheet having an image to be read by the scanner unit 12.

Eighth Modified Embodiment

In the embodiment described above, the contact-separating mechanism of the present teaching is constructed by the swingable member 30, the first regulating section 107, the second regulating section 108 and the torque limiter 32. However, it is also allowable that the contact-separating mechanism is constructed differently from the embodiment described above, provided that the contact-separating mechanism is coupled to the feed rollers 75 or the feed arm 76, and the feed rollers 75 are moved to the abutment position and the separated position by applying the rotary driving force from the second driving transmission unit 36.

Figure 14A:
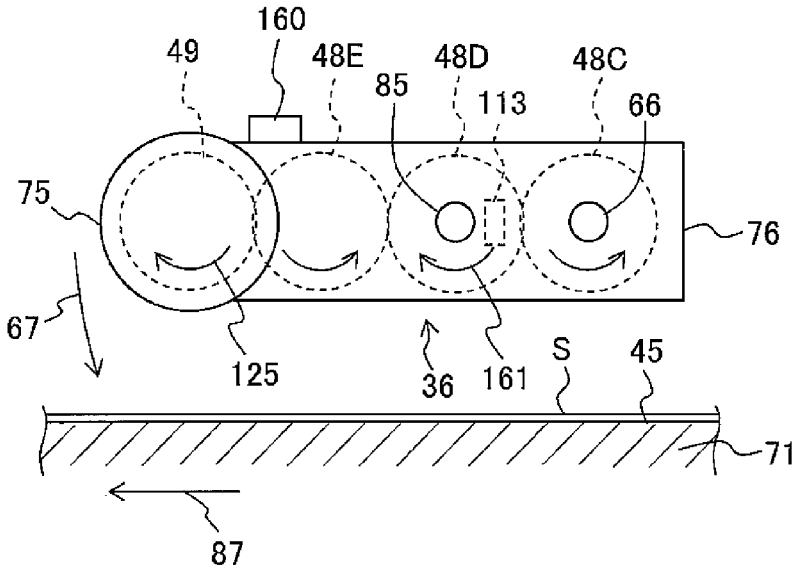
Figure 14B:
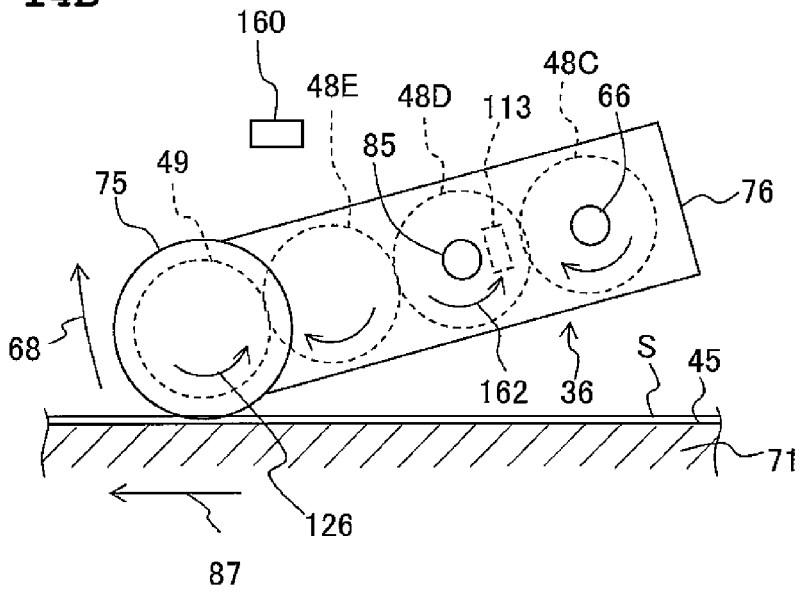

For example, as depicted in FIGS. 14A and 14B, it is also allowable that the contact-separating mechanism is constructed to include a friction member 113 which is provided between the gear 48D and the feed arm 76, a compression coil spring (not depicted) which urges the gear 48D toward the friction member 113, and a regulating section 160 which abuts against the feed arm 76 swingable in the direction of the arrow 68 (see FIG. 14B) to regulate the swing movement of the feed arm 76 in the direction of the arrow 68 at the position depicted in FIG. 14A, i.e., in the state in which the feed roller 75 is disposed at the separated position. The friction member 113 is provided on the side of the gear 48C as compared with the shaft 85 of the gear 48D. That is, the friction member 113 is provided at the position to abut against the side surface of the gear 48D in the feed arm 76, the position being disposed between the shaft 66 and the shaft 85. Further, the gear 48D is urged by the compression coil spring, and hence the friction member 113 is interposed between the gear 48D and the feed arm 76.

In the construction described above, when the feed arm 76 is disposed at the position depicted in FIG. 14A, if the rotary driving force of the forward rotation is applied to the feed rollers 75 via the second driving transmission unit 36, then the feed rollers 75 are rotated in the direction of the arrow 125 (direction to feed the recording sheet S supported by the flat surface 45 of the bypass tray 71 in the feed direction 87). In this situation, the gear 48D is rotated in the direction of the arrow 161. Accordingly, the force, which is exerted to swing the feed arm 76 in the direction of the arrow 67, is transmitted from the gear 48D via the friction member 113 to the feed arm 76. As a result, the feed arm 76 is swung in the direction of the arrow 67. When the feed arm 76 abuts against the recording sheet S supported by the bypass tray 71, the feed arm 76 feeds the recording sheet S in the feed direction 87. In this situation, any further swing movement of the feed arm 76 in the direction of the arrow 67 is regulated by the bypass tray 71.

On the other hand, when the feed arm 76 is disposed at the position depicted in FIG. 14B, if the rotary driving force of the reverse rotation is applied to the feed rollers 76 via the second driving transmission unit 36, then the feed rollers 75 are rotated in the direction of the arrow 126. In this situation, the gear 48D is rotated in the direction of the arrow 162. Accordingly, the force, which is exerted to swing the feed arm 76 in the direction of the arrow 68, is transmitted from the gear 48D via the friction member 113 to the feed arm 76. As a result, the feed arm 76 is swung in the direction of the arrow 68. Accordingly, the feed arm 76 is separated from the recording sheet S supported by the flat surface 45 of the bypass tray 71. The swing movement of the feed arm 76 in the direction of the arrow 68 is regulated by the regulating section 160 (see FIG. 14A).

In the embodiment described above, the feeding motor 78 of the driving transmission mechanism 79 is provided in the printer unit 11, and the driving gear 53, which is attached to the rotational shaft 52 of the feeding motor 78, is meshed with the gear 47A of the first driving transmission unit 35. However, the arrangement of the feeding motor 78 is not limited to this construction. For example, it is also allowable that the feeding motor 78 is arranged at the position of the intermediate gear 46 depicted in FIG. 7, and the driving gear 53, which is attached to the rotational shaft 52 of the feeding motor 78, is meshed with the gear 48A of the second driving transmission unit 35 and the gear 77A of the third driving transmission unit 37. According to this construction, the effect, which is the same as or equivalent to that of the embodiments described above, can be obtained by using only the two driving transmission units, i.e., the second driving transmission unit 35 ranging from the feeding motor 78 to the feed rollers 75 and the third driving transmission unit 37 ranging from the feeding motor 78 to the movable member 64 without using the intermediate gear 46. That is, the time, which elapses from the start of the forward rotation of the feeding motor 78 to the start of the transport of the recording sheet S by the feed rollers 75, can be made longer than the time which elapses from the start of the forward rotation of the feeding motor 78 to the movement of the movable member 64 to the retracted position, and thus, it is possible to avoid the contact between the movable member 64 and the recording sheet S fed by the feed rollers 75. Another exemplary embodiment is also available such that the rotational shaft 66 is attached to the rotational shaft 52 of the feeding motor 78 to directly rotate the rotational shaft 66 by the feeding motor 78. Also in the case of this construction, the effect, which is the same as or equivalent to that of the embodiments described above, can be obtained by means of the two driving transmission units, i.e., the driving transmission unit ranging from the rotational shaft 66 to the feed rollers 75 and the driving transmission unit ranging from the rotational shaft 66 to the movable member 64 without using the intermediate gear to be provided in order to branch the driving transmission route. In this construction, the play is provided between the left end portion of the rotational shaft 66 and the gear 48C or between the feed rollers 75 and the roller gear 49.

In the embodiment described above, the driving transmission unit, which is constructed by the first driving transmission unit 35, the intermediate gear 46 and the second driving transmission unit 36, can be considered as one driving transmission unit, and the driving transmission unit, which is constructed by the first driving transmission unit 35, the intermediate gear 46 and the third driving transmission unit 37, can be also considered as one driving transmission unit. That is, also in the embodiment described above, it is also possible to consider that the driving of the feed rollers 75 and the movable member 64 is performed by the two driving transmission units, i.e., the driving transmission unit which transmits the driving force from the feeding motor 78 to the feed rollers 75 and the driving transmission unit which transmits the driving force from the feeding motor 78 to the movable member 64.

In the above embodiments, the feed arm 76 rotatably supports the feed rollers at the one end and is swingably supported by the rotational shaft 66 at the other end. However, the feed arm 76 can rotatably support the feed rollers 75 at the position different from the one end and can be swingably supported by the rotational shaft 66 at the position different from the other end.

What is claimed is:

1. A feed apparatus comprising:

a support unit configured to support a sheet;

a feed roller configured to feed the sheet supported by the support unit in a feed direction;

an arm configured to be swingable about a swing shaft and configured to rotatably support the feed roller about a shaft different from the swing shaft;

a guide unit provided on a downstream side of the support unit in the feed direction, the guide unit having a sheet abutment surface configured to abut against the sheet fed in the feed direction to guide the sheet;

a movable member provided for the guide unit and configured to be movable to a protruding position at which the movable member protrudes from the sheet abutment surface and the movable member is able to abut against the sheet supported by the support unit and a retracted position at which the movable member is retracted from the sheet abutment surface, the movable member having a restraining surface configured to abut against the sheet to restrain the sheet;

a driving source configured to perform forward rotation and reverse rotation;

a first driving transmission unit configured to transmit a rotary driving force from the driving source to an intermediate gear;

a second driving transmission unit configured to transmit the rotary driving force from the intermediate gear to the feed roller;

a third driving transmission unit configured to transmit the rotary driving force from the intermediate gear to the movable member; and a contact-separating mechanism coupled to the feed roller or the arm and configured to move the feed roller to an abutment position at which the feed roller abuts against the sheet supported by the support unit and a separated position further from the support unit than the abutment position by means of the rotary driving force applied from the second driving transmission unit, wherein:

the feed roller is rotated in a direction to feed the sheet in the feed direction in a case that the rotary driving force of the forward rotation is applied from the driving source, and the feed roller is rotated in a direction opposite to the direction to feed the sheet in the feed direction in a case that the rotary driving force of the reverse rotation is applied from the driving source;

the movable member is shifted from the protruding position to the retracted position in a case that the rotary driving force of the forward rotation is applied from the driving source, and the movable member is shifted from the retracted position to the protruding position in a case that the rotary driving force of the reverse rotation is applied from the driving source;

the contact-separating mechanism moves the feed roller from the separated position to the abutment position in a case that the rotary driving force of the forward rotation is applied from the driving source, and the contact-separating mechanism moves the feed roller from the abutment position to the separated position in a case that the rotary driving force of the reverse rotation is applied from the driving source; and in a state in which the movable member is disposed at the protruding position and the feed roller is disposed at the separated position, a time required between start of the forward rotation of the driving source and start of feeding of the sheet by the feed roller moved from the separated position to the abutment position, the feed roller being moved by the contact-separating mechanism operated by the rotary driving force of the driving source transmitted to the contact-separating mechanism via the first driving transmission unit, the intermediate gear and the second driving transmission unit, is longer than a time required between the start of the forward rotation of the driving force and a shift of the movable member from the protruding position to the retracted position by the rotary driving force of the driving source transmitted to the movable member via the first driving transmission unit, the intermediate gear and the second driving transmission unit.

2. The feed apparatus according to claim 1, wherein, in the second transmission unit, one of a gear and a rotational shaft of the gear has a key and the other of the gear and the rotational shaft of the gear has a key groove; and a play in a circumferential direction of the gear exists between the gear and the rotational shaft.

3. The feed apparatus according to claim 1, wherein the contact-separating mechanism includes:

a swingable member coupled to the feed roller or the arm and configured to swing by the rotary driving force applied from the second driving transmission unit;

a first regulating section configured to abut against the swingable member to regulate the swing movement of the swingable member at a first position protruding toward a side of the support unit as compared with the feed roller;

a second regulating section configured to abut against the swingable member to regulate the swing movement of the swingable member at a second position retracted from the support unit as compared with the feed roller; and a torque limiter provided between the second driving transmission unit and the swingable member to transmit the rotary driving force from the second driving transmission unit to the swigable member and configured to cut off the transmission of the rotary driving force from the second driving transmission unit to the swingable member in a case that the swing movement of the swingable member is regulated by the first regulating section or the second regulating section.

4. The feed apparatus according to claim 3, wherein:

the second driving transmission unit includes a roller gear attached to a rotational shaft of the feed roller and configured to rotate about the rotational shaft of the feed roller;

one of the rotational shaft of the feed roller and the roller gear has a key, the other of the rotational shaft of the feed roller and the roller gear has a key groove, and a play in a circumferential direction of the roller gear exists between the rotational shaft of the feed roller and the roller gear; and the torque limiter is provided between the roller gear and the swingable member.

5. The feed apparatus according to claim 1, further comprising:

a protrusion regulating section configured to abut against the movable member to regulate movement of the movable member at the protruding position;

a retraction regulating section configured to abut against the movable member to regulate the movement of the movable member at the retracted position; and a torque limiter provided for the third driving transmission unit to switch presence or absence of a transmission of the rotary driving force in the third driving transmission unit, the torque limiter cutting off the transmission of the rotary driving force in the third driving transmission unit in a case that the movement of the movable member is regulated by the protrusion regulating section or the retraction regulating section.

6. The feed apparatus according to claim 1, wherein the support section is inclined with respect to a horizontal direction, and the sheet supported by the support section is urged by gravity in the feed direction.

7. An image recording apparatus comprising:

the feed apparatus as defined in claim 1; and a recording unit which is provided on a downstream side of the guide unit in the feed direction and configured to record an image on the sheet fed by the feed roller.

8. A feed apparatus comprising:

a support unit provided with a support surface and configured to support a sheet via the support surface;

a feed roller configured to feed the sheet supported by the support unit in a feed direction;

an arm which is swingable about a swing shaft and configured to rotatably support the feed roller about a shaft different from the swing shaft;

a guide unit which is provided on a downstream side of the support unit in the feed direction, the guide section having a sheet abutment surface configured to abut against the sheet fed in the feed direction to guide the sheet;

a movable member provided for the guide unit, the movable member being movable to a protruding position at which the movable member protrudes from the sheet abutment surface and the movable member is able to abut against the sheet supported by the support unit and a retracted position at which the movable member is retracted from the sheet abutment surface;

a driving source configured to supply a rotary driving force;

a first driving transmission unit configured to transmit the rotary driving force from the driving source to the feed roller;

a second driving transmission unit configured to transmits the rotary driving force from the driving source to the movable member; and a contact-separating mechanism coupled to the feed roller or the arm and configured to move the feed roller to an abutment position at which the feed roller abuts against the sheet supported by the support unit and a separated position on a side opposite to the support surface in relation to the abutment position in a direction orthogonal to the support surface by means of the rotary driving force applied from the first driving transmission unit, wherein:

a time required to transmit the rotary driving force from the driving source to the contact-separating mechanism and the feed roller via the first driving transmission unit, shift the feed roller from the separated position to the abutment position and start a feed of the sheet with the shifted feed roller, after start of a rotation of the driving source is longer than a time required to transmit the rotary driving force from the driving source to the movable member via the second driving transmission unit and shift the movable member at the protruding position to the retracted position, after the start of the rotation of the driving source.

* * * * *